US011584578B2

(12) United States Patent
Rapparini et al.

(10) Patent No.: US 11,584,578 B2
(45) Date of Patent: Feb. 21, 2023

(54) FLEXIBLE MATERIAL PACKAGES

(71) Applicant: ICA S.P.A., Bologna (IT)

(72) Inventors: Gino Rapparini, Bologna (IT); Pietro Crescimbeni, Bologna (IT)

(73) Assignee: ICA S.P.A., Bologna (IT)

( * ) Notice: Subject to any disclaimer, the term of this patent is extended or adjusted under 35 U.S.C. 154(b) by 142 days.

(21) Appl. No.: 16/650,342

(22) PCT Filed: Sep. 20, 2018

(86) PCT No.: PCT/IB2018/057237

§ 371 (c)(1),
(2) Date: Mar. 24, 2020

(87) PCT Pub. No.: WO2019/064129

PCT Pub. Date: Apr. 4, 2019

(65) Prior Publication Data

US 2020/0290787 A1 Sep. 17, 2020

(30) Foreign Application Priority Data

Sep. 26, 2017 (IT) ..... 102017000107549

(51) Int. Cl.
*B65D 75/56* (2006.01)
*B65B 61/16* (2006.01)
(Continued)

(52) U.S. Cl.
CPC ..... *B65D 75/566* (2013.01); *B31B 70/008* (2017.08); *B31B 70/872* (2017.08);
(Continued)

(58) Field of Classification Search
CPC ..... B65D 75/566; B65D 33/08; B65D 33/02; B65D 33/06; B65D 33/065; B65D 33/12;
(Continued)

(56) References Cited

U.S. PATENT DOCUMENTS 1,410,404 A * 3/1922 Haines ..... B65D 33/08 15/104.8
2,486,178 A * 10/1949 Kuehlhorn ..... B65D 81/18 229/117.14

(Continued)

FOREIGN PATENT DOCUMENTS

DE 1932046 1/1971
DE 10146765 12/2002

OTHER PUBLICATIONS

International Search Report for corresponding International Application No. PCT/IB2018/057237, dated Feb. 14, 2019; 2 pages.

*Primary Examiner* — Gloria R Weeks
*Assistant Examiner* — Mobeen Ahmed
(74) *Attorney, Agent, or Firm* — Fattibene and Fattibene, LLC; Paul A. Fattibene

(57) ABSTRACT

A flexible material package (100, 200) is presented comprising a reinforcing element (3) and a first sealed area (103) positioned close to the upper end of the package (100, 200) and preferably configured so as to close the package (100, 200), wherein the reinforcing element (3) is at least partially positioned within the first sealed area (103), the package (100, 200) further comprising gripping means positioned vertically below the reinforcing element (3) and configured so as to be used to support the package (100, 200). A closing method, a filling method and a formation method of the package (100, 200) are also presented.

8 Claims, 21 Drawing Sheets

(51) Int. Cl.

| | |
|---|---|
| ***B65D 33/02*** | (2006.01) |
| ***B65D 33/08*** | (2006.01) |
| ***B31B 70/00*** | (2017.01) |
| ***B65D 5/44*** | (2006.01) |
| ***B31B 70/86*** | (2017.01) |

(52) U.S. Cl.
CPC ..... *B31B 70/874* (2017.08); *B65B 61/16* (2013.01); *B65D 5/445* (2013.01); *B65D 33/02* (2013.01); *B65D 33/08* (2013.01)

(58) Field of Classification Search
CPC ..... B65D 57/00; B65D 5/445; B65D 5/4208; B65B 61/16; B65B 29/04; B65B 61/14; B31B 70/008; B31B 70/866; B31B 70/872; B31B 70/876
USPC ..... 53/134.1
See application file for complete search history.

(56) References Cited

U.S. PATENT DOCUMENTS 4,018,142 A * 4/1977 Canno ..... B65D 5/46056 493/224
4,216,899 A * 8/1980 Kamp ..... B65D 33/08 383/17
4,566,252 A * 1/1986 Watanabe ..... B65B 61/16 53/413
4,690,280 A * 9/1987 Meyer ..... B31B 70/00 206/820
4,817,866 A * 4/1989 Wonnacott ..... B65D 71/30 206/427
5,013,004 A * 5/1991 Wilkins ..... B65D 73/0071 248/692
5,083,413 A * 1/1992 Bennett ..... B65D 33/246 53/134.1
5,558,438 A * 9/1996 Warr ..... B65D 75/5816 383/17
5,912,197 A * 6/1999 Madderom ..... B65B 61/188 442/305
6,598,746 B2 * 7/2003 Lux, Jr. ..... B65D 5/445 206/778
6,923,574 B2 * 8/2005 Siegel ..... B65D 33/2533 383/17
8,597,168 B2 * 12/2013 Koesters ..... B65D 31/10 53/134.1
9,469,423 B2 * 10/2016 Thomas, Jr. ..... B65D 75/008
10,189,609 B2 * 1/2019 Pellingra ..... B65D 33/065
11,053,033 B1 * 7/2021 Hunter ..... B65B 15/00
2002/0023408 A1 * 2/2002 Bitowft ..... B65B 61/14 53/413
2002/0102032 A1 * 8/2002 Sturgis ..... B65D 33/08 383/906
2003/0094461 A1 * 5/2003 Knol ..... B65D 5/701 221/305
2003/0179957 A1 * 9/2003 Tankersley ..... B65B 9/24 53/413
2004/0224830 A1 * 11/2004 Fujishiro ..... B31B 70/00 493/186
2005/0053313 A1 * 3/2005 Lucas ..... B65D 75/566 383/16
2005/0276521 A1 * 12/2005 Price ..... B65D 33/005 383/105
2006/0012200 A1 * 1/2006 Kohn ..... B65D 33/065 294/157
2006/0030470 A1 * 2/2006 Voss ..... B65B 9/13 493/194
2006/0042007 A1 * 3/2006 Kohn ..... B65D 33/065 5/114
2008/0010945 A1 * 1/2008 McKenna ..... B65B 61/14 53/134.1
2009/0022430 A1 * 1/2009 Hutchison ..... B65D 33/06 29/700
2009/0170681 A1 * 7/2009 Kohn ..... B65D 33/065 493/223
2011/0041457 A1 * 2/2011 Montano ..... B29C 66/4312 53/373.7
2013/0126370 A1 * 5/2013 DiLiberto ..... A61J 1/2093 206/219
2015/0251815 A1 * 9/2015 Berger ..... B31B 70/876 156/69
2016/0023809 A1 * 1/2016 Leeker ..... B65B 61/16 493/227
2016/0060003 A1 * 3/2016 Wood ..... B65D 75/5877 222/92
2016/0083146 A1 * 3/2016 Han ..... B65D 33/08 53/413
2017/0029190 A1 * 2/2017 Barton ..... B65D 75/008
2017/0166358 A1 * 6/2017 Chandaria ..... B65D 31/10
2017/0253385 A1 * 9/2017 Sargin ..... B65D 31/04
2018/0170622 A1 * 6/2018 Pellingra ..... B65D 33/1616
2018/0319545 A1 * 11/2018 Reeves ..... B65D 33/02
2018/0362218 A1 * 12/2018 Reeves ..... B65D 33/08
2019/0359363 A1 * 11/2019 Su ..... B65D 33/105
2020/0346798 A1 * 11/2020 Lambertz ..... B29C 65/18
2022/0089329 A1 * 3/2022 Forsblom ..... B65D 33/20

* cited by examiner

FLEXIBLE MATERIAL PACKAGES

TECHNICAL FIELD

The present invention relates to the field of flexible material packages. In particular, the present invention relates to a flexible material package having at least one reinforcing element for preventing the breaking of the package when supported by means of gripping means. Moreover, the present invention relates to a method for closing, one for filling and one for producing such packages.

BACKGROUND

Large quantities of flexible material packages with gripping means are present on the market. Often, the gripping means constitute an integral part of the package and are made so as to be gripped or taken by the hand to allow for example, a lifting operation. Alternatively, such gripping means may also be used to hang the packages for example, along a sliding track.

Such packages often also have a reclosable opening because for the most part they are used in medium-large formats. Due to the weight of the material contained in the packages, it is possible for the gripping means to deteriorate over time. Indeed, by raising and lowering the package several times, it is for example possible for the force exerted by a user to move the package to irreversibly ruin the gripping means, thus creating for example a tear.

Often a solution used is the one of making packages with a flexible material having an increased thickness so as to have an increased resistance to the loads. However, this solution has two main disadvantages: the first consists of the increase of the cost of the package because thicker material also has a greater cost; the second consists of an increased waste of material and therefore implies making a less sustainable package.

Therefore, in light of that described above, the present invention deals with the problem of making flexible material packages with gripping means capable of effectively preventing a breaking of the package caused by the weight force acting on the contents of the package. Moreover, the present invention deals with the problem of making packages that are affordable and sustainable.

SUMMARY

The present invention is based on the idea of making a reinforcing element positioned above gripping means so as to ensure an increased resistance of the flexible material package.

Within the scope of the present invention, unless otherwise specified, the terms "width", "height", "lower" and "upper" refer to the geometry of the package considering a view of the package wherein the mouth of the package occupies the highest level.

According to one embodiment of the present invention, a flexible material package is supplied comprising a reinforcing element and a first welded area positioned close to the upper end of the package and preferably configured so as to close the package, wherein the reinforcing element is at least partially positioned within said first welded area, the package further comprises gripping means positioned at least partially vertically below the reinforcing element and configured so as to be used to support the package. This solution is particularly advantageous because it allows having a sustainable package simultaneously capable of resisting increased forces exerted in the support means. The gripping means may be for example, one or more openings inside of which there may be inserted one or more fingers of a user so as to raise or more generally, move the package. Such gripping means may also be represented by an opening configured so that the package may be hung for example, along a sliding track. Moreover, the fact that the first welded area closes the package and that the reinforcing element is positioned at least partially within the first welded area allows having a welding that not only closes the package, but simultaneously allows positioning the reinforcing element in a given position. However, it is apparent that there is no need for such welding to also close the mouth of the package. Moreover, in the case in which the package is held in the gripping means by a user, the reinforcing element is highly advantageous because it allows acting as support and the weight force of the material that pushes downwards is therefore counterbalanced by the upwards force exerted by the user in the gripping means and that is absorbed by the support element. Moreover, being positioned vertically below the reinforcing element allows the gripping means not to be torn. This is because even if on the one hand a tear may be formed that continues from the two side ends of the gripping means, the extension of such tear line may effectively be "stopped" by the reinforcing element, therefore preventing a possible tear from extending further. It is apparent that for the purposes of the invention, there is no need for the reinforcing element to be completely positioned above the gripping means, rather it is sufficient for a part thereof to be positioned above in order to "stop" the possible tear.

According to a further embodiment of the present invention, there is provided a package wherein the lower end of the reinforcing element is positioned lower than the upper end of the gripping means. This solution is particularly advantageous because it allows effectively preventing a horizontal tear of the gripping means because the reinforcing element has a portion positioned at the bottom with respect to the gripping means.

According to a further embodiment of the present invention, there is provided a package wherein the reinforcing element is at least partially positioned between the front wall and the rear wall of the package, and such reinforcing element preferably has a flat shape that is weldable on both faces. This solution is particularly advantageous because it allows positioning the reinforcing element between the two walls of the mouth of the package in closing step of the package, thus allowing no additional elements to be inserted after performing the closing. Moreover, the fact that the reinforcing element preferably has a flat shape allows easily inserting such element into the mouth of the package and having very low costs for making such element. Moreover, thanks to this feature, the reinforcing element may preferably be provided already cut or also from a reel. It is also apparent that receiving the reinforcement directly from a reel is particularly advantageous because it allows significantly decreasing the production times and also making the production process more automated. Moreover, having the reinforcing element that is weldable on both faces allows it to be welded both to the front face and to the rear face of the package, thus having a more stable reinforcement. It is apparent that flat shape means a planar structure, therefore having a bi-dimensional extension. For the purposes of the invention, it is indeed not necessary for the flat surfaces to be perfectly smooth.

According to a further embodiment of the present invention, there is provided a package wherein the reinforcing element is a pre-cut element inserted individually at least partially in the mouth of the package.

According to a further embodiment of the present invention, there is provided a package wherein the reinforcing element is an element obtained from a reel.

According to a further embodiment of the present invention, there is provided a package wherein the reinforcing element has a thickness that is greater than or equal to the thickness of the flexible material from which the package is made and/or is made of a different material with respect to the flexible material of the package. This solution is advantageous for two main reasons. The first concerns the fact that having a thickness greater than or equal to the thickness of the flexible material allows significantly increasing the resistance of the gripping means positioned at the bottom with respect to the reinforcing element. The second concerns the fact that having such a reinforcing element allows having a flexible material package made from a thinner material, wherein unlike the packages commonly used, the thickness of the material used is not mainly dictated by the resistance of the gripping means.

According to a further embodiment of the present invention, there is provided a package wherein the reinforcing element is positioned centrally with respect to the upper mouth of the package. This solution is advantageous because it allows having the reinforcing element, and preferably also the gripping means, positioned centrally with respect to the package and therefore allowing a balanced grip of the package.

According to a further embodiment of the present invention, there is provided a package wherein the reinforcing element partially protrudes from the first welded surface outside of the package. This solution is particularly advantageous because it allows indicating to the user that the package is equipped with a reinforcing element and that therefore such package may be transported without particular precautions such as for example, placing a hand under the bottom of the package to prevent the breaking of the gripping means. Moreover, such protrusion may be used to draw images or apply advertising, which is particularly apparent thanks to the position of such protrusion. Moreover, such protrusion is very important in closing the package also from a practical viewpoint because it allows having a greater margin of error in positioning the reinforcing element.

According to a further embodiment of the present invention, there is provided a package wherein the gripping means of the package are represented by a handle, preferably formed from a pre-cut line so as to provide a facilitated opening, the handle is positioned vertically below the reinforcing element and is configured so as to allow a grip of the package. This solution is particularly advantageous because it allows having a pre-formed handle that is made by exerting a pressure at the facilitated opening represented by the pre-cut line. This solution is also advantageous from an aesthetical viewpoint because after the package is filled and closed, the surface of the package is homogenous, that is it has no holes.

According to a further embodiment of the present invention, there is provided a package wherein the package further has a second welded area within which the pre-cut line is positioned. This embodiment allows having a handle completely within a welded area, thus effectively avoiding the material from possibly coming out of the package through the handle. Preferably, the pre-cut line is completely contained within a welded area that even more preferably is represented by the second welded area.

According to a further embodiment of the present invention, there is provided a package wherein the reinforcement is at least partially positioned within the second welded area. This solution is particularly advantageous because it allows further securing the position of the reinforcing element and effectively preventing a possible movement thereof. Moreover, this solution is also advantageous because it ensures an increased rigidity and stability at the mouth of the package because having the reinforcing element fastened to the first and to the second welding effectively allows increasing the rigidity. This therefore implies having a more rigid structure that starts from the first welded area and reaches the second welded area through the reinforcing element.

According to a further embodiment of the present invention, there is provided a package wherein the first welded area and the second welded area are adjacent to each other. This implies that the first welded area and the second welded area are in communication with each other because as mentioned, they have at least one adjacent portion. This solution is particularly advantageous firstly because it allows effectively reducing the area occupied by the welded surface. Secondly it is also possible to make the first welded area and the second welded area in a singlewelding, therefore having a single welded area in this particular case. This solution is therefore advantageous because it allows also having a single welding that allows securing the reinforcing element inside the mouth of the package and closing the mouth of the package and making the gripping means therein.

According to a further embodiment of the present invention, there is provided a package wherein the pre-cut line and the reinforcing element do not overlap. This solution is particularly advantageous because it is very important for the pre-cut line to be completely made in a completely external area with respect to the reinforcing element. This is due to the fact that the pre-cut positioned inside the reinforcing element could result in the possible breaking of the reinforcing element. Indeed, if part of the pre-cut line were made at an area occupied by the reinforcing element, this would create a breaking point at such area, that is a breakage for the cut also within the reinforcement itself.

According to a further embodiment of the present invention, there is provided a package wherein the upper end of the gripping means positioned vertically below the reinforcing element has a distance from the lower end of the reinforcing element—positioned on the same vertical—that is greater than zero, preferably greater than 1 mm. This solution is particularly advantageous because it is very important for the pre-cut line to be completely made in a completely external area with respect to the reinforcing element. Moreover, having a distance between the two elements allows having greater margins of error so as to have an increased reliability of the packages made.

According to a further embodiment of the present invention, there is provided a package wherein the package is a package that has a left bellow and a right bellow and that has four welded vertical side corners, or a package of the doypack type. Moreover, it is more generally possible to use any type of package, also a bag, etc. so long as provided with gripping means.

According to another embodiment of the present invention, there is provided a method for closing a flexible material package, wherein the method comprises the following steps:

a. positioning a reinforcing element having a flat shape that is weldable on both faces, at the upper mouth of the package;

b. Welding a first area close to the upper mouth of the package so as to block the reinforcing element and preferably close the upper mouth of the package.

This solution is particularly advantageous because it allows having a sustainable package simultaneously capable of resisting increased forces exerted by the gripping means positioned close to the upper mouth of the package. Indeed, in the case in which the package is held in the gripping means by a user, the reinforcing element is configured so as to act as support and the weight force of the material that pushes downwards is counterbalanced by the upwards force exerted by the user in the gripping means and that is absorbed by the support element. The gripping means may for example be one or more openings inside of which there may be inserted one or more fingers of a user so as to effectively raise or lower the package. Moreover, the fact that the first welded area closes the package and that the reinforcing element is blocked in the first welded area allows having a welding that not only allows closing the package but simultaneously also allows positioning the reinforcing element in a given position. However, it is apparent that there is no need for such welding to also close the mouth of the package. Moreover, in the case in which the package made by means of the present method is held in the gripping means by a user, the reinforcing element is highly advantageous because it allows acting as support and the weight force of the material that pushes downwards is therefore counterbalanced by the upwards force exerted by the user in the gripping means and that is absorbed by the support element.

According to a further embodiment of the present invention, there is provided a method for closing a flexible material package, wherein the reinforcing element is provided pre-cut and is positioned individually at the upper mouth of the package in said positioning step.

According to a further embodiment of the present invention, there is provided a method for closing a flexible material package, wherein the reinforcing element is provided from a reel in said positioning step. This solution is particularly advantageous because it allows speeding up the insertion process.

According to a further embodiment of the present invention, there is provided a method comprising the following step:

c. cutting along a pre-cut line so as to provide a facilitated opening for forming a handle of the package, wherein the pre-cut line is positioned vertically below the reinforcing element.

This solution is particularly advantageous because it allows having a pre-formed handle that is made by exerting a pressure at the facilitated opening of the pre-cut line. This solution is also advantageous from an aesthetical viewpoint because after the package is filled and closed, the surface of the package is homogenous, that is it has no holes.

According to a further embodiment of the present invention, there is provided a method comprising the following step:

d. welding a second area close to the first welded area, wherein the pre-cut line is positioned within the second welded area.

This embodiment allows preferably having a handle completely within a welded area, thus effectively avoiding the material inside the package from possibly coming out through the handle.

According to a further embodiment of the present invention, there is provided a method for filling a package that comprises the following steps:

a) step of filling the package;

b) step of closing the package according to one of the above-described embodiments of the present invention.

This solution is particularly advantageous because it allows obtaining the handle only after filling the package. Indeed, in the case in which the pre-cut were made before the filling step of the package, the material introduced during such step could partly come out of the pre-cut, thus causing losses of material.

According to a further embodiment of the present invention, there is provided a method for forming a package, that comprises the following steps:

a) step of forming the package;

b) step of closing the package according to one of the above-described embodiments of the present invention.

BRIEF DESCRIPTION OF THE DRAWINGS

The present invention is described with reference to the accompanying drawings in which the same reference numbers and/or marks indicate the same parts and/or similar parts and/or corresponding parts of the system.

DETAILED DESCRIPTION

Figure 1:
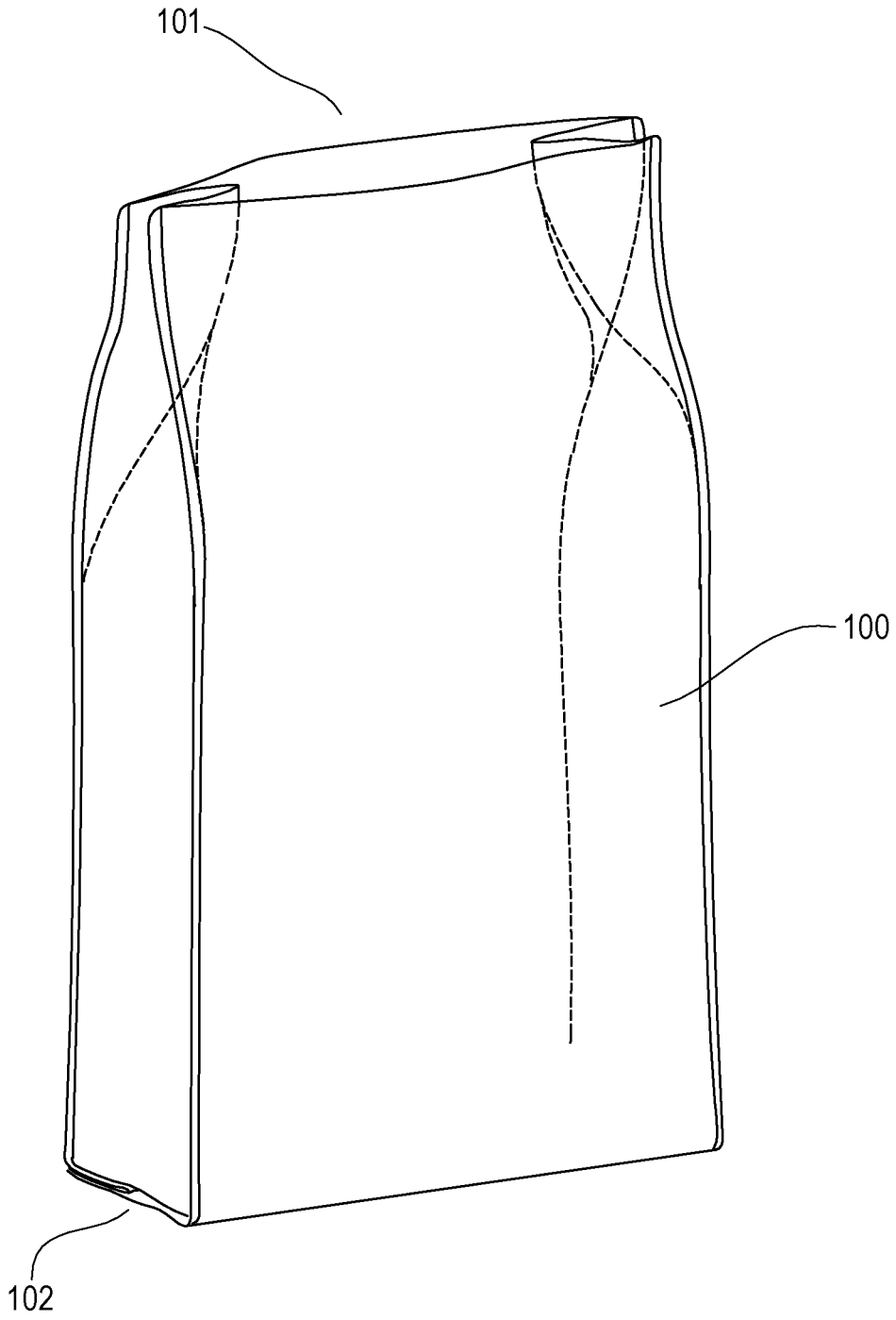
FIG. 1 diagrammatically shows a three-dimensional view of a package having four corners and a folded bottom.

The present invention is described hereinbelow by making reference to particular embodiments, as illustrated in the accompanying drawings. However, the present invention is not limited to the particular embodiments described in the following detailed description and depicted in the drawings, rather the embodiments described simply exemplify the various aspects of the present invention, the scope of which is defined by the claims. Further modifications and variations of the present invention will be apparent to those skilled in art.

FIG. 1 diagrammatically shows a package 100 according to one embodiment of the present invention. The package 100 is made of flexible material with bellows, starting from a film on a reel. The package 100 is depicted with welded corners and a flat folded bottom 102 blocked with glue. Such features are not fundamental but are depicted in the drawing to facilitate the comprehension thereof. Generally such types of packages relate to the pet-food sector, the food sector for rice, flour, coffee beans, etc. The materials usually used for this type of packages are plastic-based pre-coupled multilayer film made of polythene such as PE+PP or a barrier film having several layers such as PE+AL+PP.

Moreover, such package 100 has an upper mouth 101 configured so that the contents of the package may be introduced therein.

With reference to FIGS. 2 to 7, the method is described for closing a package 100 having a reinforcing element 3 according to one embodiment of the invention.

Figure 2:
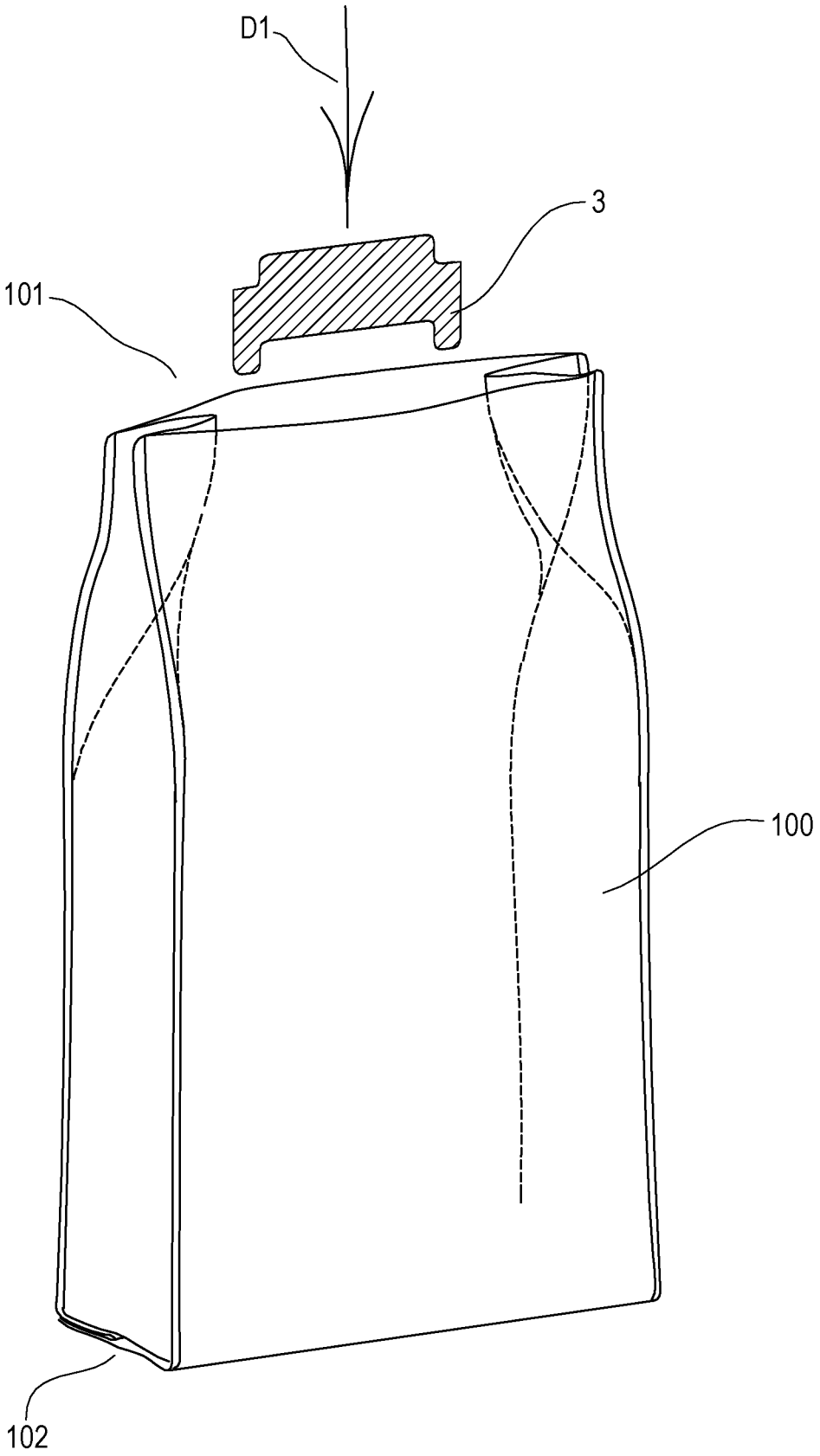
FIG. 2 diagrammatically shows a three-dimensional view of the step of introducing a reinforcing element according to one embodiment of the present invention.
Figure 3:
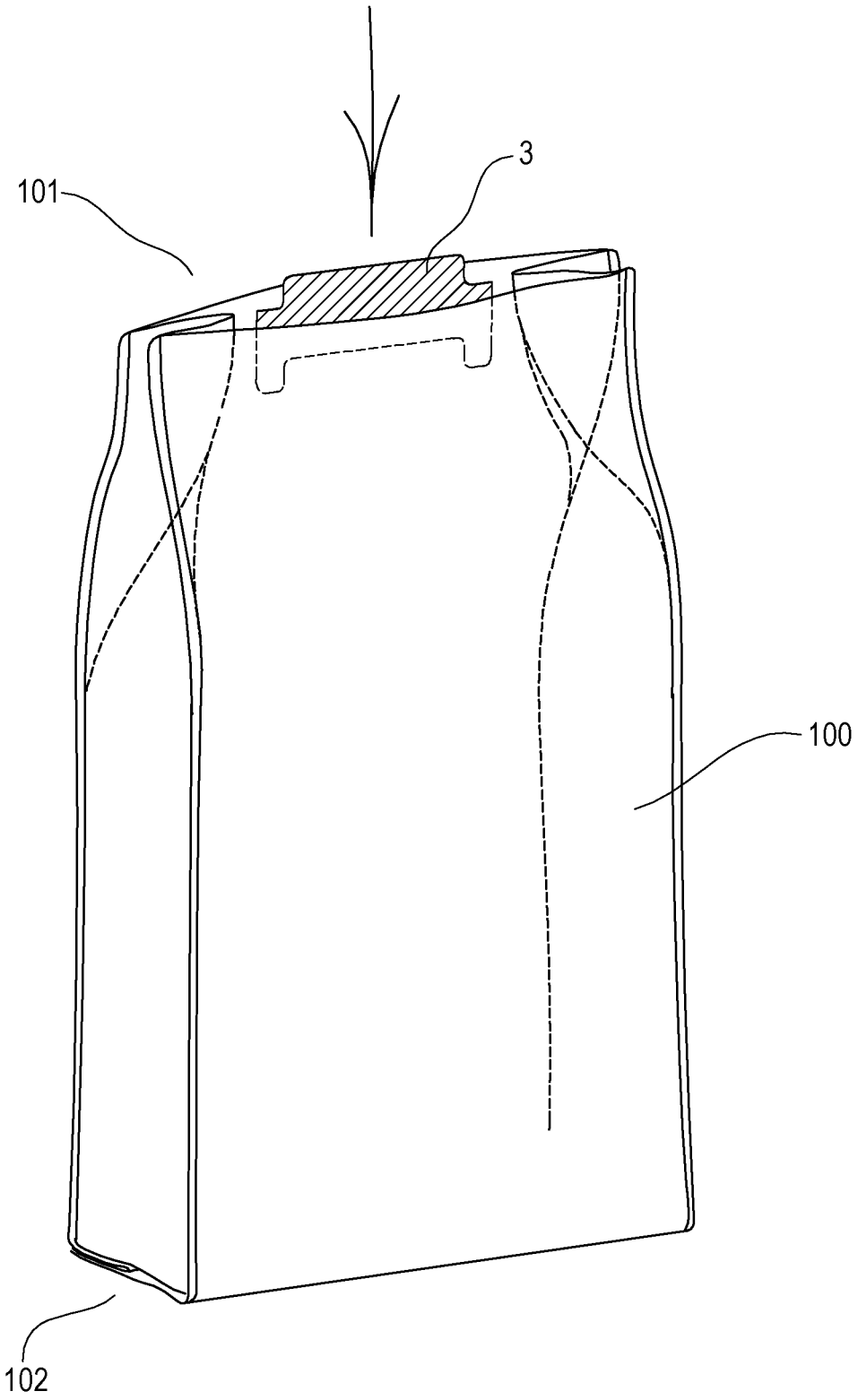
FIG. 3 diagrammatically shows a three-dimensional view of a step successive to the one depicted in FIG. 2, wherein the reinforcing element is introduced at the mouth of the package.

As shown in FIG. 2, a reinforcing element 3, which is described below, is conducted along the vertical direction D1 towards the mouth 101 of the package 100. As shown in FIG. 3, the reinforcing element 3 is partially conducted inside the mouth 101 of the package 100. Moreover, it is positioned between the front wall and the rear wall of the package 100. In this particular embodiment, a part of the reinforcing element 3 is kept outside the mouth 101 of the package 100 so that the reinforcing element may be kept stationary in such position with extreme facility.

Figure 4:
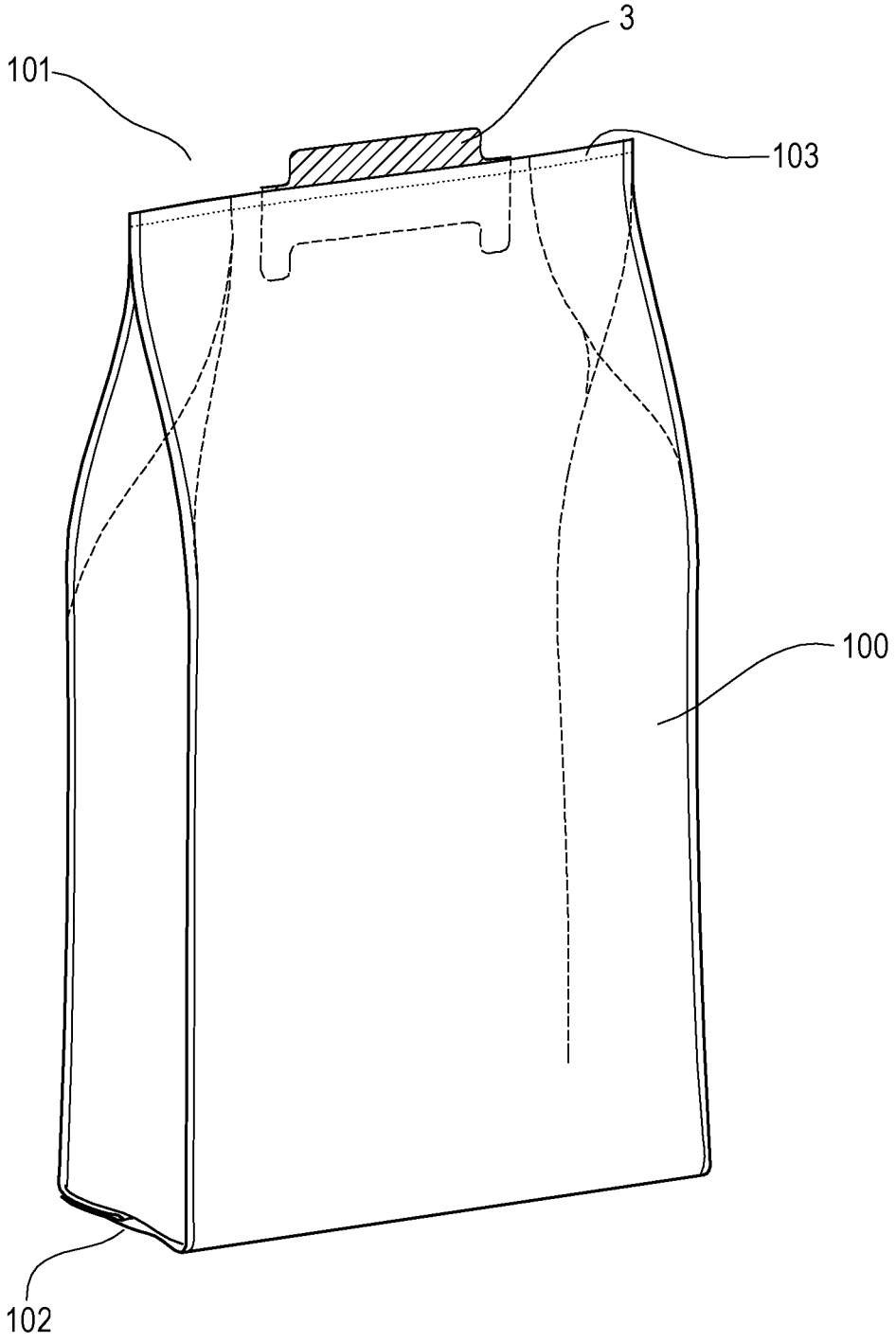
FIG. 4 diagrammatically shows a three-dimensional view of a step successive to the one depicted in FIG. 3, wherein the package was closed by means of first welding.

In a successive step shown in FIG. 4, the upper mouth 101 of the package 100 is closed by means of a welding. A first possibility for making such welding is for example, heated bar welding. Other possible solutions are represented by ultrasound welding, impulse welding and induction welding. As shown in the drawing, such welding has a rectangular shape however it is clear that it may have any shape capable of closing the mouth of the package.

The package 100 is closed in this manner, but given that the reinforcing element 3 is positioned between the front wall and the rear wall of the package 100, the reinforcing element 3 simultaneously is secured to the package 100 by means of welding this first welded area 103.

It is apparent that the protruding part of the reinforcing element 3 that comes out of the mouth 101 of the package 100 after the package 100 was closed, may have a height at will according to that desired by the manufacturer of the package 100. Indeed, if on the one hand such protrusion is useful for keeping the reinforcing element 3 in fixed position before the welding of the first welded area 103 is performed, such protrusion they also be larger so as to use such protruding surface, for example, for drawings or advertising. Moreover, it is also possible for such protrusion to be completely inexistent and for the reinforcing element to be wholly contained within the mouth of the package 100.

As shown in the drawing, a second welding is made at a second welded area 104 in a successive step. Such second welded area 104 is positioned at the bottom in vertical direction with respect to the first welded area 103 and the two welded areas 103 and 104 are adjacent to each other. Also in this case, the welding may be made for example, with any method such as for example: heated bar welding, ultrasound welding, pulse welding and induction welding.

The blanking along a pre-cut line 105 by means of for example, a toothed knife, occurs within the second welded area 104. Such pre-cut line 105 allows making a facilitated opening. Indeed, such pre-cut line has alternating through stretches and non-through stretches through the second welded area 104.

It is preferable for the pre-cut line 105 to be completely made in an area that is completely external to the reinforcing element 3. This is due to the fact that the pre-cut of the reinforcing element could result in the possible breaking of the reinforcing element. Indeed, if part of the pre-cut line 105 were made at an area occupied by the reinforcing element, this would create a breaking point at such area, that is a breakage for the cut also within the reinforcement itself.

Figure 6:
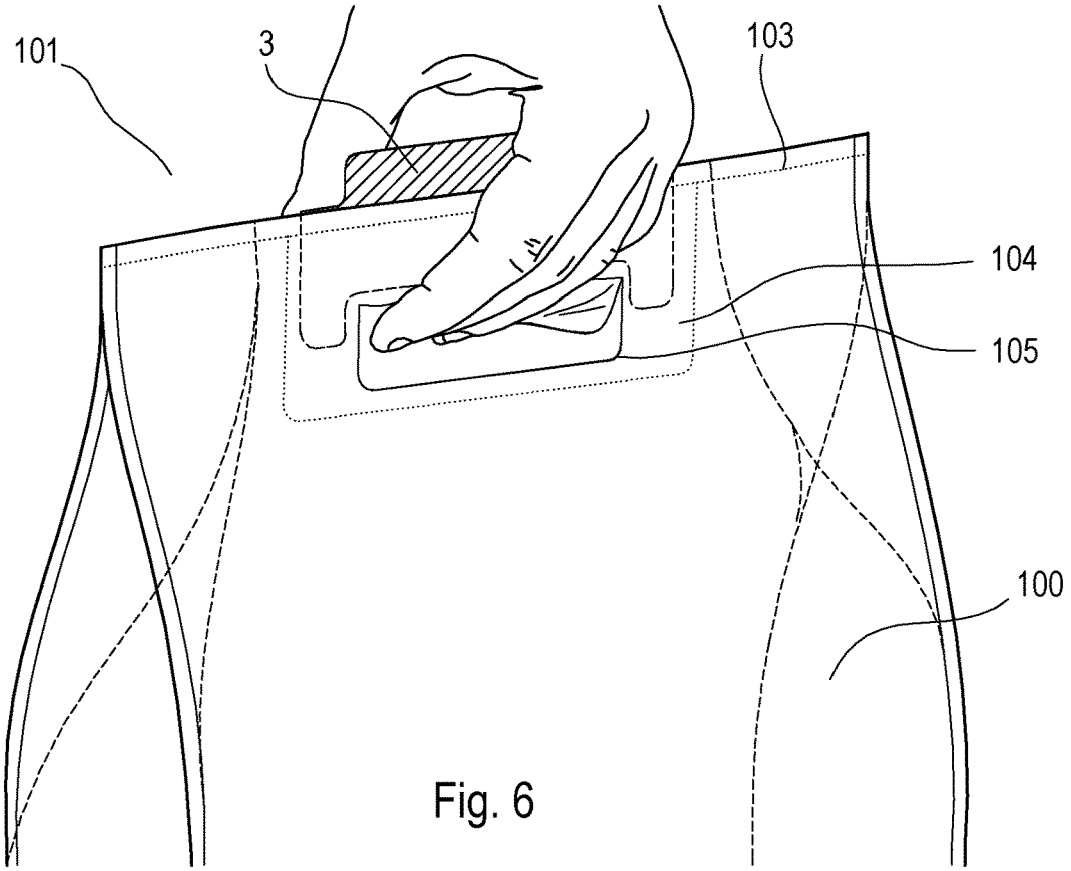
FIG. 6 diagrammatically shows a three-dimensional view of a step successive to the one depicted in FIG. 5, wherein the handle is formed.

By exerting a pressure on the inner part of the pre-cut line 105 in a successive step as shown in FIG. 6, a grip of the package may be formed and the fingers of a user may be introduced in the opening thus formed. Indeed, thanks to the pressure exerted on the inner part of the pre-cut line 105, the non-through stretches are opened and thus an opening of the package is formed.

Figure 7:
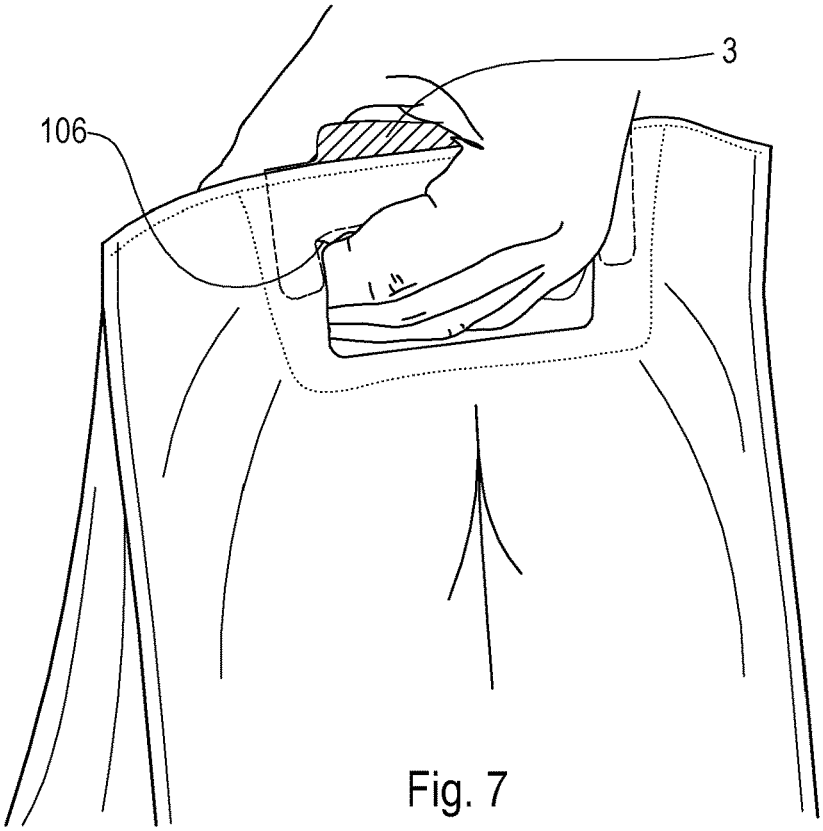
FIG. 7 diagrammatically shows a three-dimensional view of the step of using the handle of FIG. 6.

Therefore, the package 100 may thus be raised and lowered at will. As shown in FIG. 7, a user may thus transport the package 100 by gripping through the opening formed from the pre-cut line 105. Thereby, also the reinforcing element 3 is gripped, which is capable therefore of preventing a possible breaking of the package 100 at the upper end of the package 100.

Indeed as shown in FIG. 7, a tear 106 that continues from the two upper ends of the pre-cut line 105 may be formed also during the lifting of very heavy packages. However, the extension of such tear line 106 is effectively "stopped" by the reinforcing element 3, therefore preventing the tear from further extending.

With reference to FIGS. 8 to 15, four possible different types of reinforcing elements are described in detail.

Figure 5:
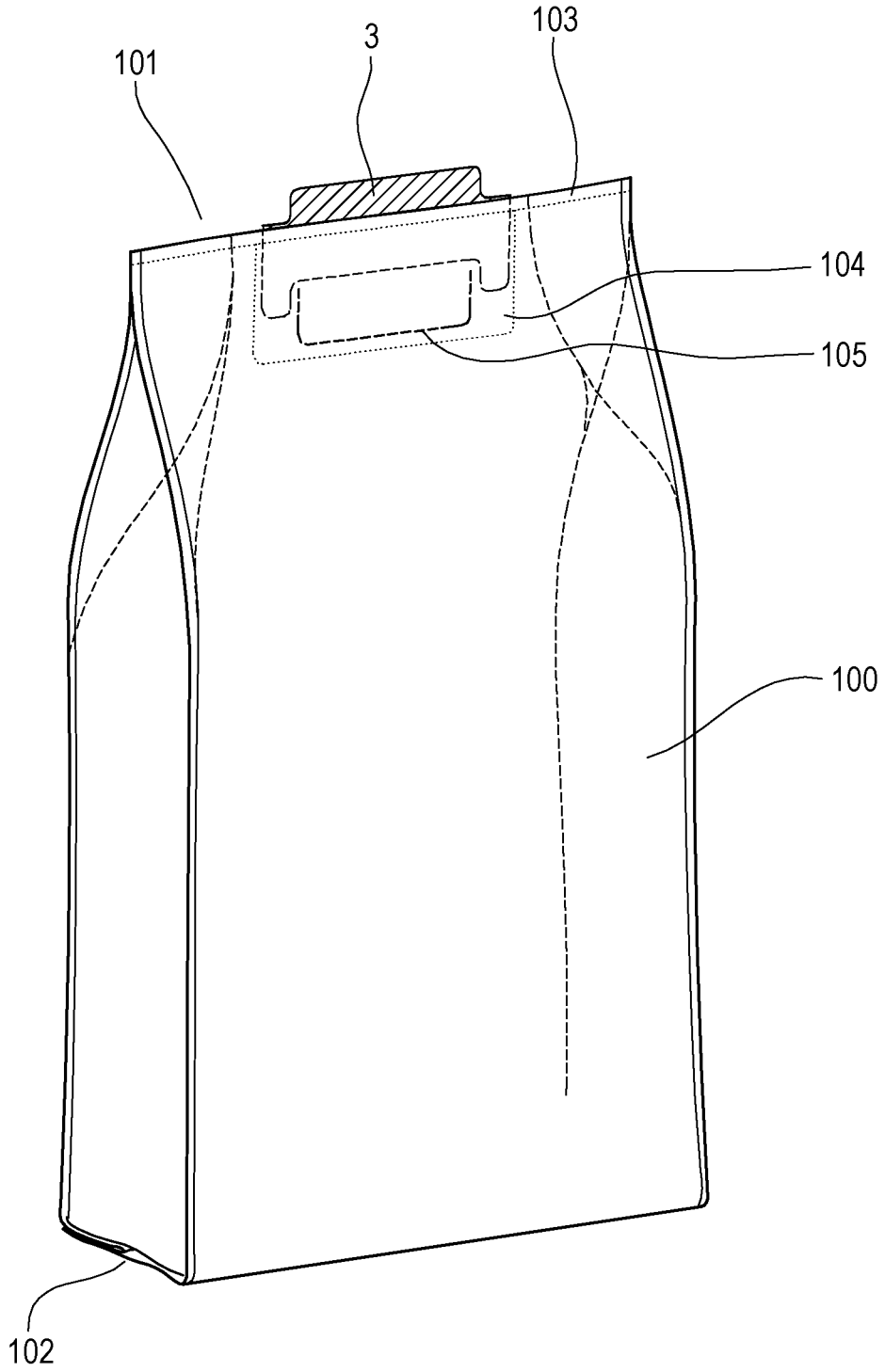
FIG. 5 diagrammatically shows a three-dimensional view of a step successive to the one depicted in FIG. 4, after a second welding and a pre-cut line for the formation of a handle was made according to a particular embodiment of the present invention.

As shown in FIG. 5 and as depicted in greater detail in FIG. 8, the upper end of the pre-cut line 105 is positioned vertically below the reinforcing element. As shown in the drawing, this means that there is a distance L5 between the upper end of the pre-cut line 105 and the lower part of the reinforcing element 3 positioned on the vertical of the upper end of the pre-cut line 105. Such distance may take on a value at will, for example it may be greater than 1 mm so as to ensure a certain positioning tolerance. Indeed as already described above, it is important for there to be such distance so that the handle made from the pre-cut line 105 does not affect the reinforcing element 3.

Figure 8:
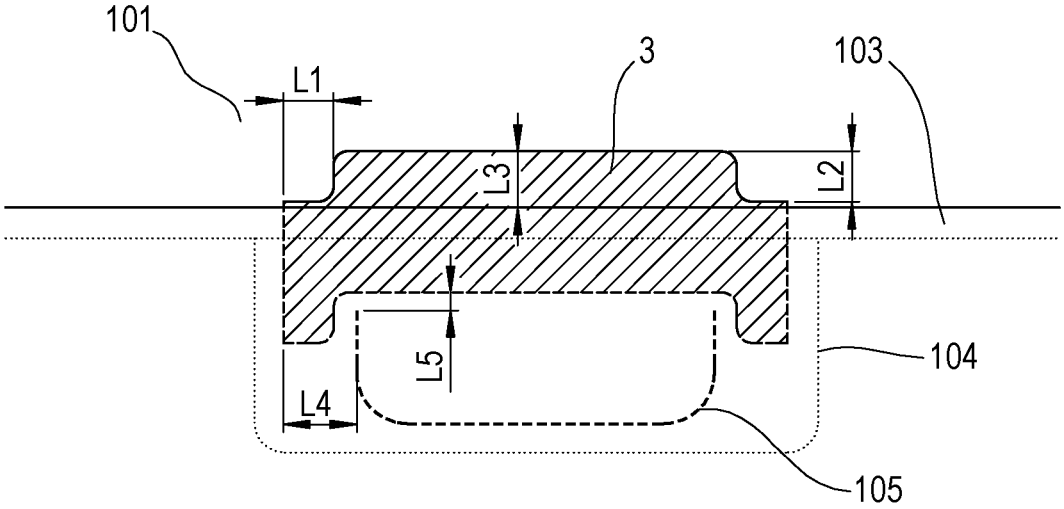
FIG. 8 shows a front view of a detail of the mouth of FIG. 5.
Figure 9:
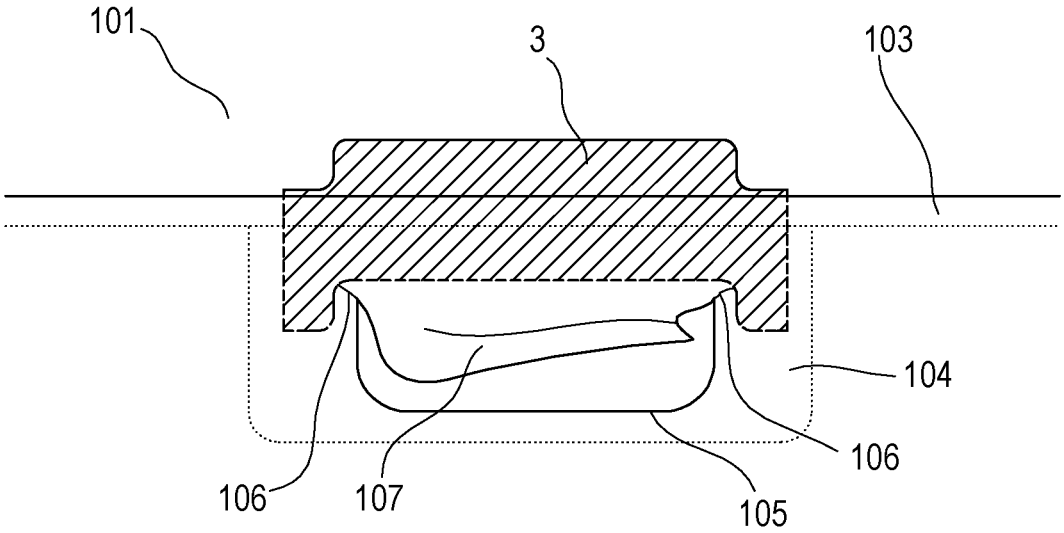
FIG. 9 shows the mouth of FIG. 8 after the handle was used.

The reinforcing element 3 described in FIGS. 8 and 9 is the same one depicted in FIGS. 1 to 7. Such reinforcing element 3 has a flat shape and as mentioned, may be provided already pre-cut or on a reel. Therefore, in the case in which the reinforcing element 3 is provided from a reel, there may be a continuous supply of such reinforcing element 3. Alternatively as mentioned, the reinforcing element may also be an element that was pre-cut and inserted at a later time at the mouth of the package.

The reinforcing element 3 may be made of a film similar to the one with which the package 100 is made. However, both surfaces of the reinforcing element 3 (front and rear) must be welding surfaces so that the reinforcing element 3 may be welded both with the front surface and with the rear one of the mouth of the package 100. The thickness of the reinforcing element may preferably be in the range of a tenth of millimeter, for example comprised between 1 and 2 tenths of a millimeter.

As shown in FIG. 8, the reinforcing element 3—which has a flat shape—stands out for having a greater width with respect to the width of the pre-cut line 105. This is mainly due to the fact that not only are the greatest efforts present in the vertically upper part with respect to the pre-cut line 105 during the gripping of the package through the opening formed from the pre-cut line 105, but also in the vertically upper and immediately lateral part with respect to the pre-cut line 105. Moreover, in this manner it is also possible to effectively stop a tear line 106 which could propagate starting from the upper ends of the pre-cut line 105.

Moreover, this reinforcing element 3 has a rectangular shape with a recess located on the lower central part of the reinforcing element 3 to allow the reinforcing element 3 to have a lower end positioned lower than the upper end of the pre-cut line 105. In this manner, the tear line 106 of the package that starts from the pre-cut line 105 may be effectively stopped both in the case in which the tear line propagates in an upwards oblique direction and in the case in which it propagates horizontally.

The effect of this contrivance consists in having the tear line 106 completely "trapped" inside the reinforcing element 3. As is shown in FIG. 9, indeed once a pressure has been exerted on the inner area with respect to the pre-cut line 105, the tab 107 is closed to the right and to the left by the reinforcing element 3, thus effectively preventing a possible breaking of the opening.

Therefore, as described in relation to FIG. 7, the extension of the tear line 106 is thus stopped by the reinforcing element 3.

Moreover as shown in FIG. 8, the reinforcing element 3 has two chamfers in the upper part thereof: a right one and a left one. Such chamfers have a height L2 that is less than the height L3 of the protrusion of the reinforcing element 3. Moreover, such chamfers have a width L1 that is less than the distance L4 between the right or left lateral end of the reinforcing element 3 and the corresponding right or left lateral end of the pre-cut line 105. Thanks to this contrivance, there are no trimmings when obtaining the reinforcement 3 from a reel. This is due to the fact that one reinforcement may be "fit" in another in this manner, that is matching the upper end of one reinforcing element with the recess located on the lower central part of the preceding reinforcing element.

Figure 10:
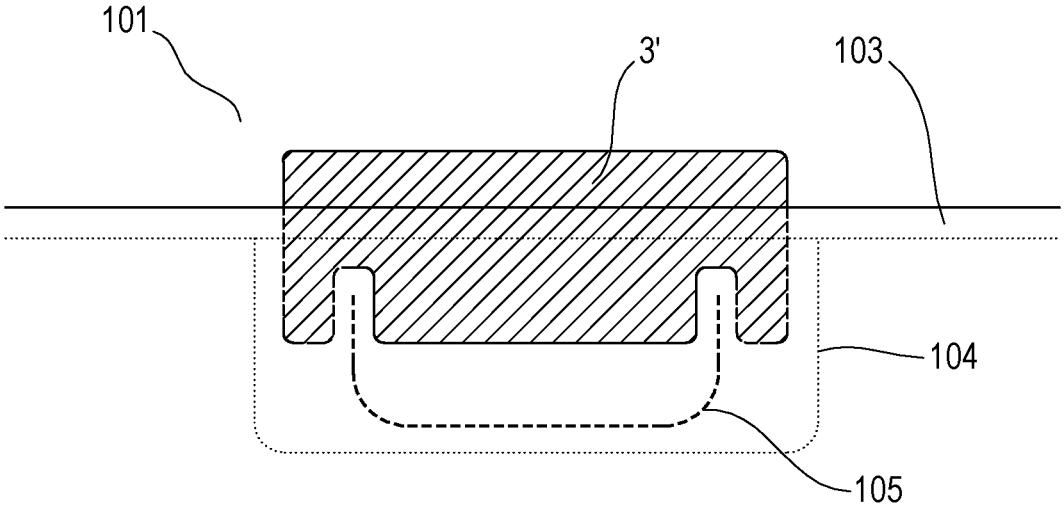
FIG. 10 shows a front view of a detail of the mouth of FIG. 5 with a reinforcing element according to a further embodiment of the present invention.
Figure 11A:
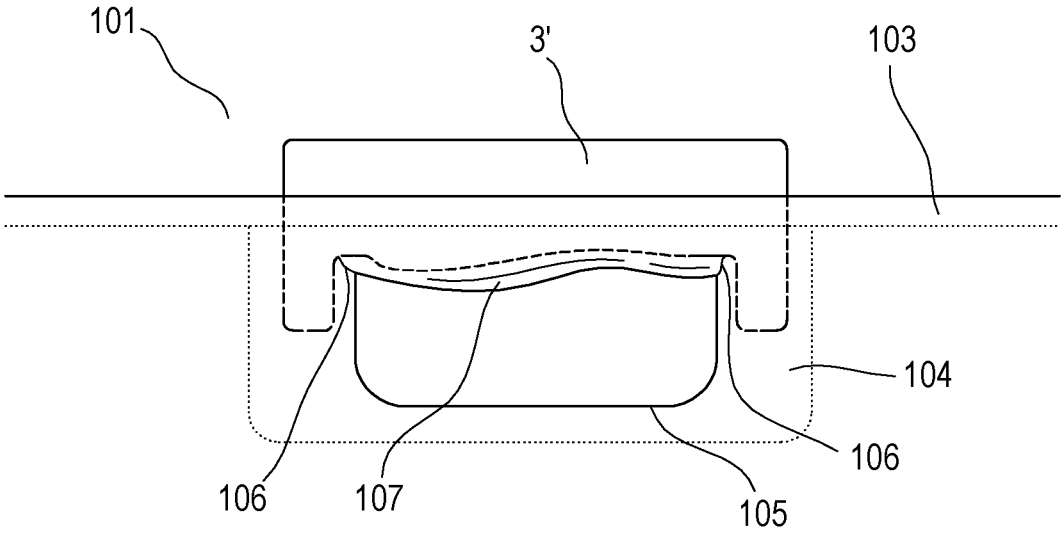
FIGS. 11A and 11B respectively show a front view and a three-dimensional view of the mouth of FIG. 10 after the handle was used.
Figure 11B:
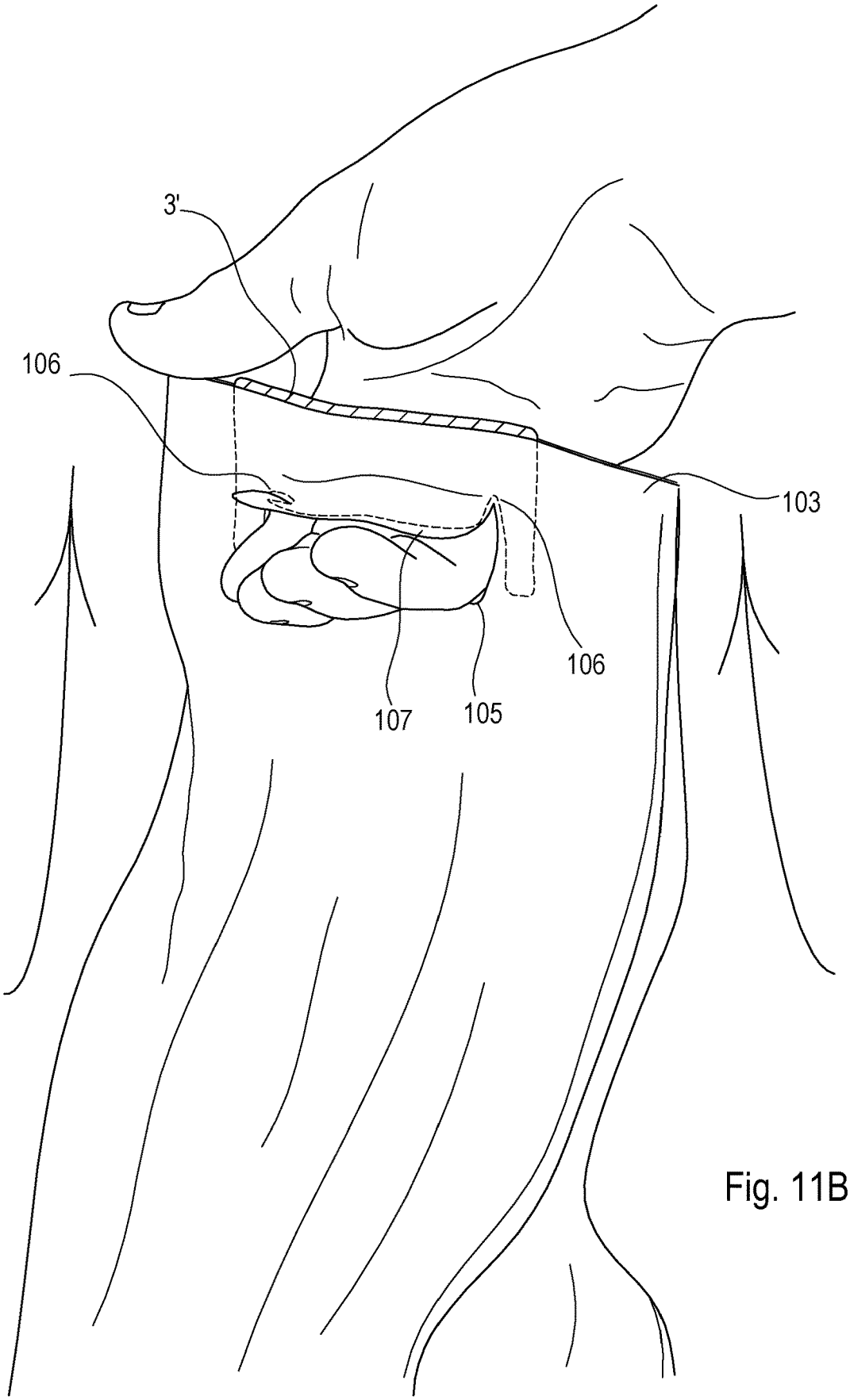

As shown for example in FIGS. 10, 11A and 11B, it is also possible for such chamfers not to be performed. Indeed, the reinforcing element 3' depicted in FIGS. 10, 11A and 11B has a rectangular shape with two recesses alone placed at the upper ends of the pre-cut line 105. In this manner, this reinforcing element 3' has a lower end positioned lower than the upper end of the pre-cut line 105.

Thanks to this contrivance, the tear line 106, which may be formed after the use of the handle, may be effectively "trapped" inside the two recesses of the reinforcing element 3', thus preventing a breaking of the mouth of the package. However according to this particular configuration, in the case in which the reinforcing element 3' is supplied from a reel, trimmings would be obtained because the upper part of a reinforcing element would not "fit" with the lower part of another one.

Moreover, according to this particular example, the handle is more reinforced because the part of reinforcing element comprised between the two recesses strengthens and makes the grip of the handle stronger with respect to the case described above.

Additionally as shown in FIG. 11B, the handle is more ergonomic when it is gripped, thanks to the fact that the reinforcing element 3' has a part comprised between the two recesses.

Indeed, by raising the package 100, the reinforcing part comprised between the two recesses folds inside a user's hand, thus increasing the resting surface on the palm. This means that the weight of the package is distributed more equally over the surface of the palm of the hand and therefore that the specific pressure caused by the package 100 on the palm itself is decreased. Moreover, thanks to the shape of the reinforcement 3' and as shown in FIG. 11B, the inner part of the reinforcement 3' is not cleanly folded, rather it follows the shape of the hand, thus providing more support to the palm of the hand.

Therefore, a reinforcement 3' like the one described not only allows reinforcing the handle of the package, but allows distributing the weight force of the package over an extended area that is represented by the reinforcing part comprised between the two recesses. Thus, there is a lower specific pressure on the palm of the hand due to the fact that the force is exerted over a broader surface. Indeed contrarily, in the case in which for example the reinforcing element does not have the part comprised between the two recesses, the weight force would act along the lower line of the reinforcing element, thus having an increased specific pressure and therefore being cutting.

Therefore, this particular embodiment simultaneously allows "trapping" the tear and having a more supported handle grip.

Figure 12:
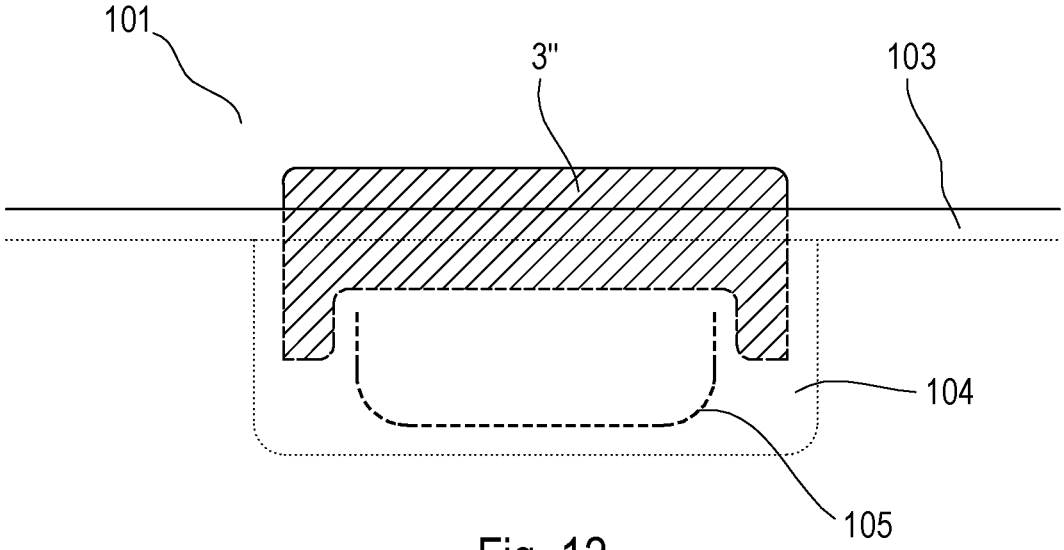
FIG. 12 shows a front view of a detail of the mouth of FIG. 5 with a reinforcing element according to a further embodiment of the present invention.
Figure 13:
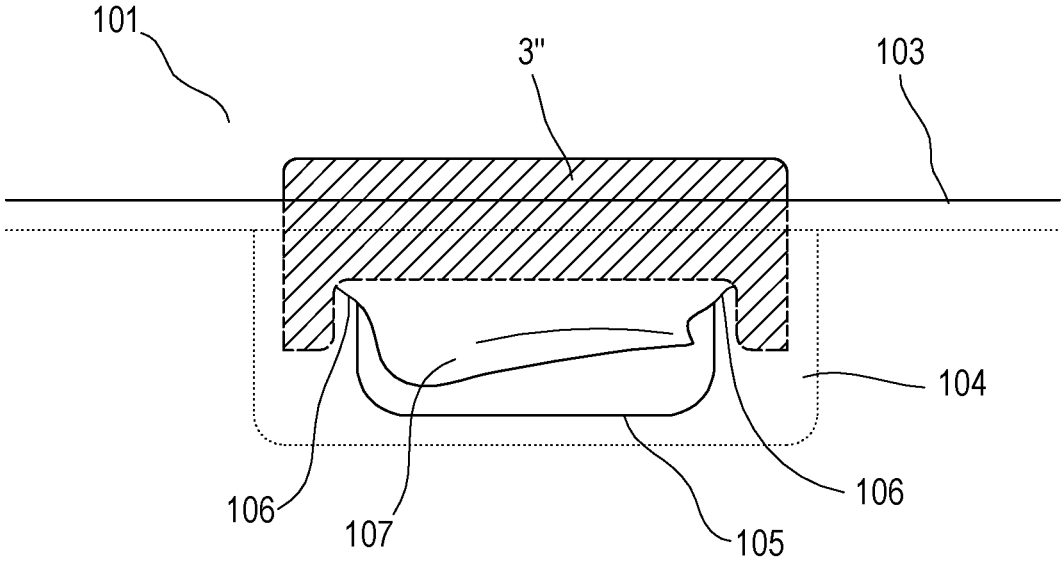
FIG. 13 shows the mouth of FIG. 10 after the handle was used.

The reinforcing element 3" also depicted in the example in FIGS. 12 and 13 has a substantially rectangular shape, with the only above-described recess in the lower central part, and therefore without a chamfer in the upper part, which instead is shown in the particular example in FIGS. 8 and 9. As mentioned above, such recess allows the reinforcing element 3" to have the lower end positioned lower than the upper end of the pre-cut line 105. However in this case, if the reinforcing element is supplied from a reel, trimmings would be obtained because the upper part of a reinforcing element would not "fit" with the lower part of another one. Nevertheless, this solution is also highly advantageous because like the case described above, it allows having the possibility of allowing the tear line 106 to be closed by the reinforcing element both in the case in which the tear line propagates oblique upwards and in the case in which it propagates horizontally.

Figure 14:
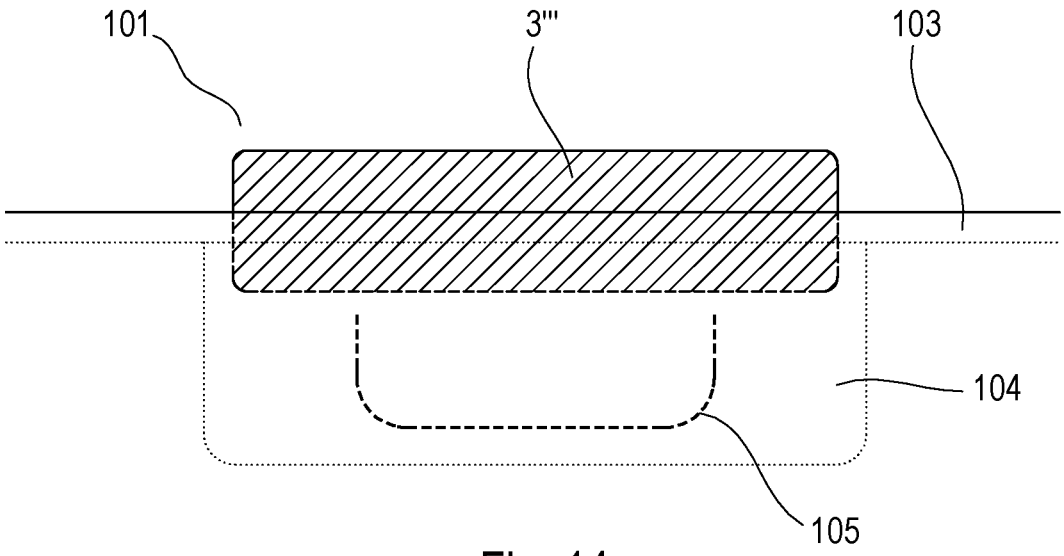
FIG. 14 shows a front view of a detail of the mouth of FIG. 5 with a reinforcing element according to a further embodiment of the present invention.
Figure 15:
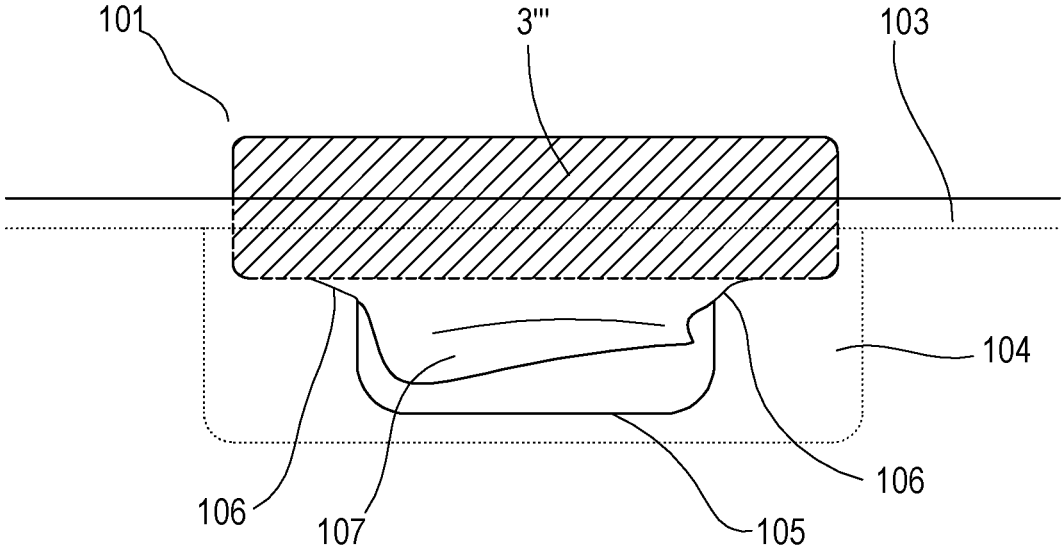
FIG. 15 shows the mouth of FIG. 12 after the handle was used.
Figure 16:
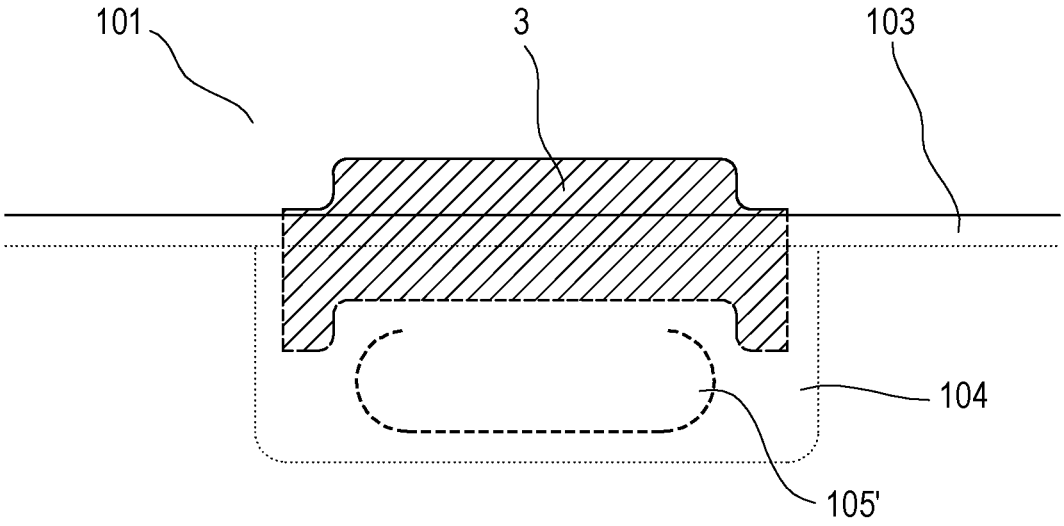
FIG. 16 shows a front view of a detail of the mouth of FIG. 5 with a pre-cut line according to a further embodiment of the present invention.
Figure 17:
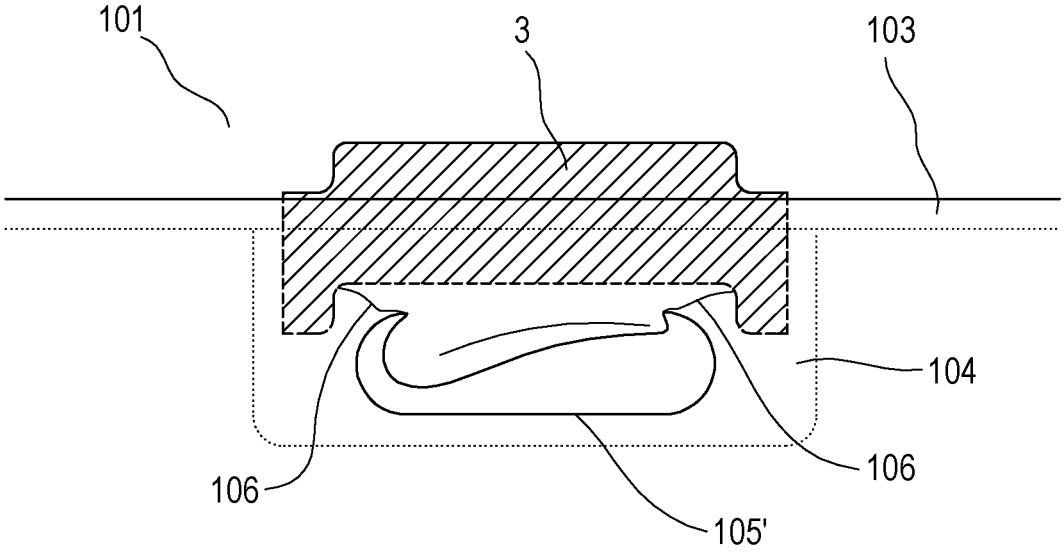
FIG. 17 shows the mouth of FIG. 14 after the handle was used.
Figure 18:
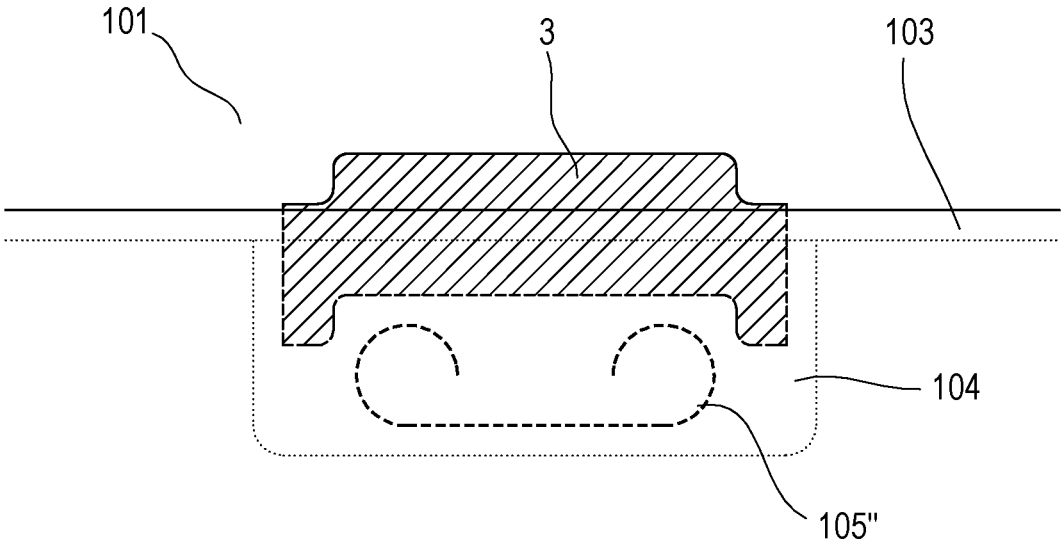
FIG. 18 shows a front view of a detail of the mouth of FIG. 5 with a pre-cut line according to a further embodiment of the present invention.
Figure 19:
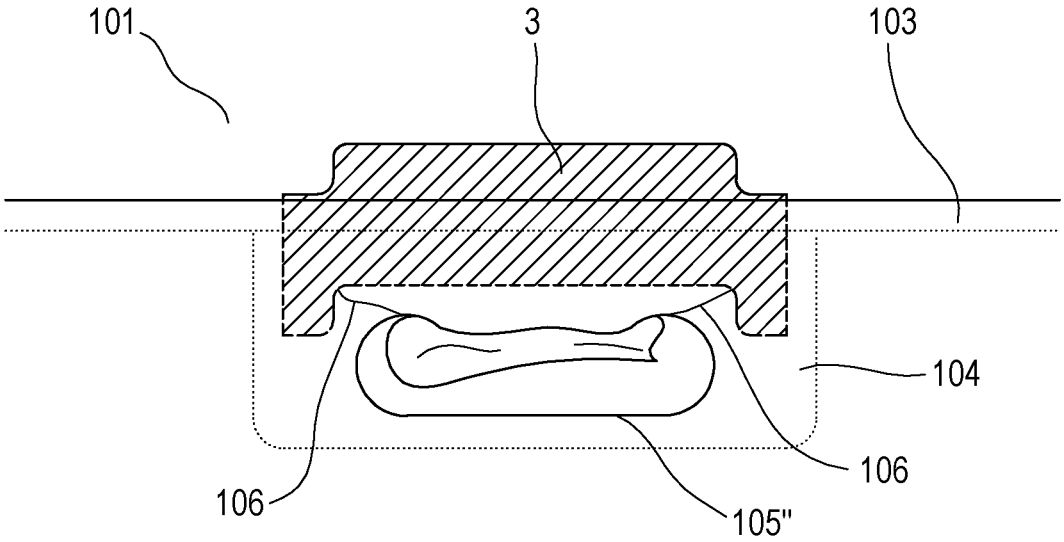
FIG. 19 shows the mouth of FIG. 16 after the handle was used.
Figure 20:
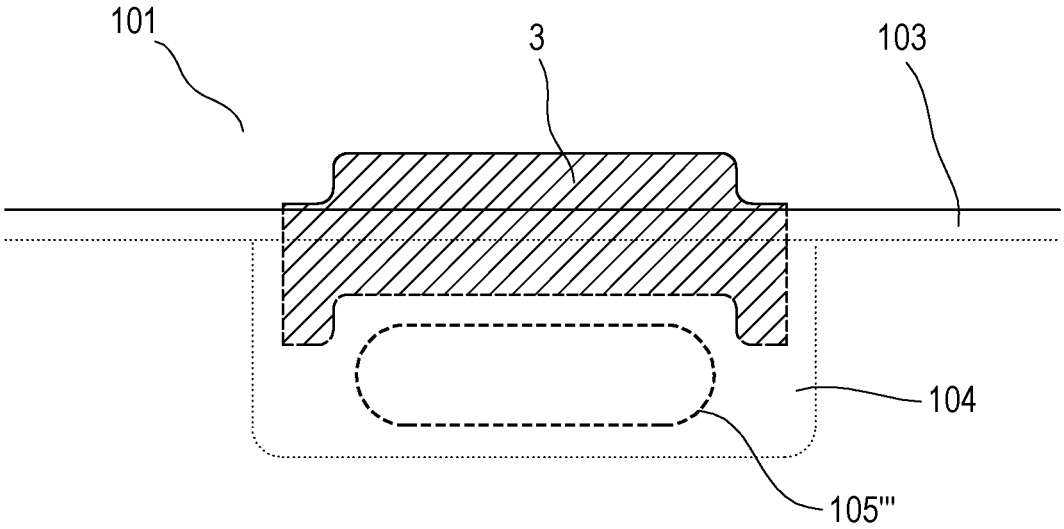
FIG. 20 shows a front view of a detail of the mouth of FIG. 5 with a pre-cut line according to a further embodiment of the present invention.
Figure 21:
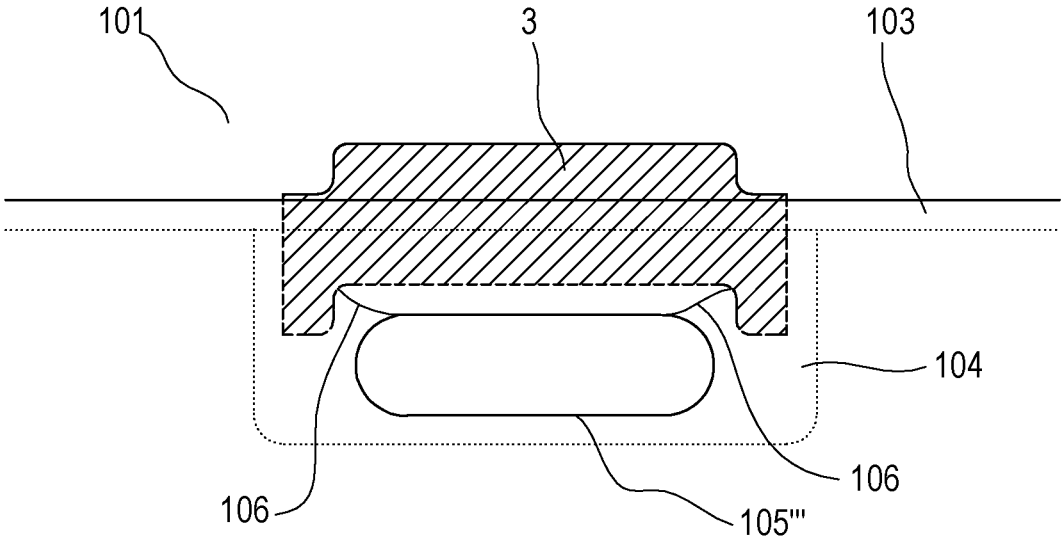
FIG. 21 shows the mouth of FIG. 18 after the handle was used.

As shown in FIGS. 14 and 15, to significantly simplify making the reinforcing element, it is possible to make a reinforcing element 3'" that has a substantially rectangular shape, without any particular recess. As shown in FIG. 14, in this case the width of the reinforcing element 3'" preferably is greater with respect to the one of the above-introduced reinforcing elements 3, 3' and 3".

In any case, also if the reinforcing element 3'" is completely positioned above the pre-cut line 105, the fact that the reinforcing element 3'" has a greater width with respect to the width of the pre-cut line 105 effectively prevents the possible breaking of the grip of the package 100 formed from the pre-cut line 105. Indeed, as shown in FIG. 15, the extension of the cut of the tear line 106 is also stopped in this case by the reinforcing element 3".

However, in the case in which the tear line 106 propagates vertically, once it encounters the reinforcing element 3'", it could continue horizontally following the reinforcement profile. For this reason, such shape of the reinforcing element normally is preferred in the case a package is involved with contents that are not too heavy, and in the case in which lower manufacturing costs are wanted.

The reinforcing element 3, 3', 3", 3'" herein described, together with part of the first welded area 103 of the second welded area 104, forms a kind of handle that constitutes an integral part of the package 100 and is made so as to be taken or gripped by the hand to allow for example, a lifting operation. Such handle is very useful in the event packages 100 are involved having relatively large sizes, for example of the volume of 10 l, because they facilitate the lifting operation. As mentioned above and shown in the drawing, the handle is completely contained within the second welded surface 104 and therefore material inside the package 100 coming out through the handle is thus effectively precluded.

Two other examples of reinforcing element are described below with reference to FIGS. 27 to 30.

FIGS. 5 to 15 introduce a pre-cut line having an elongated U shape. With reference to FIGS. 16 to 21, different examples are introduced of pre-cut lines that may be used alternatively. When combined with a reinforcing element like the one introduced in the present invention, such types of pre-cut lines allow effectively resolving the problem of the tearing during the use of the support means of the package and ensuring a more ergonomic grip of the handle.

It is apparent that even if such pre-cut lines are always depicted in reference to the reinforcing element 3, each of the pre-cut lines may also be combined with any one of the reinforcing elements 3, 3', 3", 3'" introduced above. Moreover, it is clear that the pre-cut lines may be replaced by cut lines, thus avoiding the user from having to "open" the handle by applying a pressure along the pre-cut line.

Figure 22:
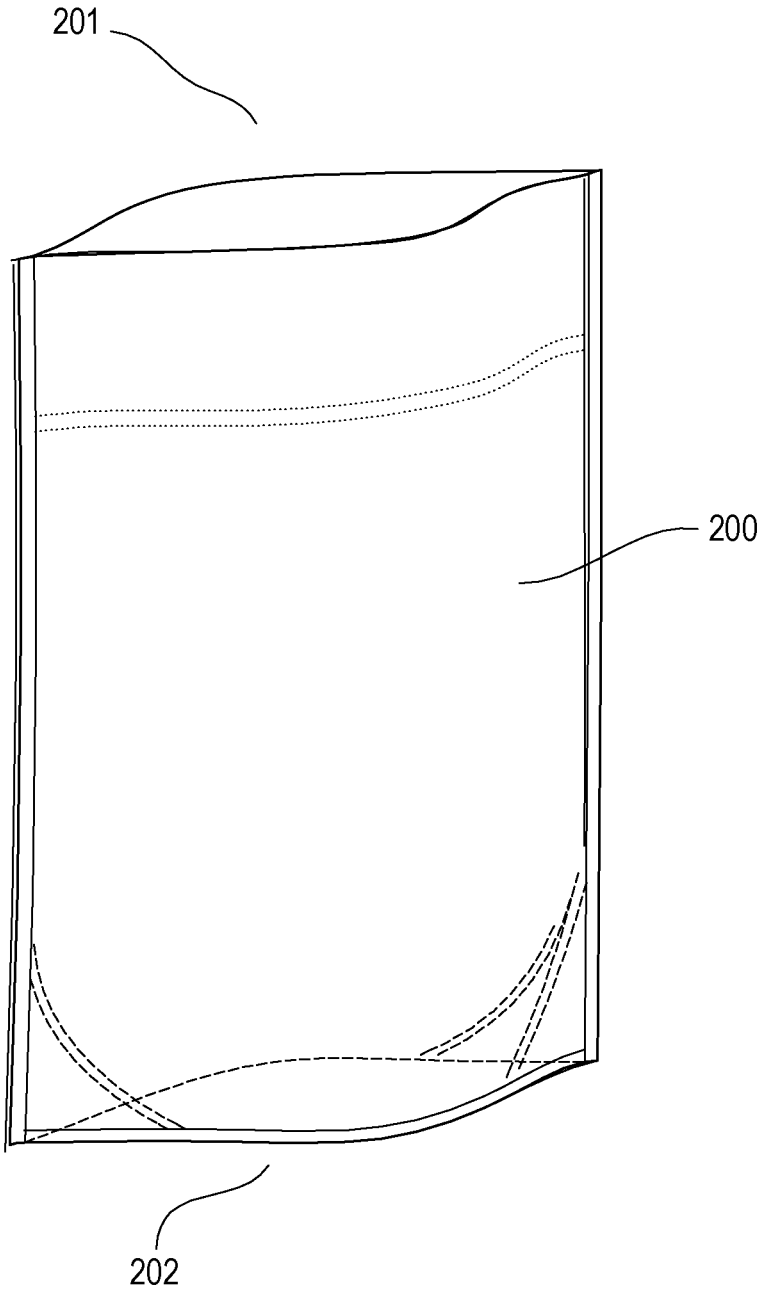
FIG. 22 diagrammatically shows a three-dimensional view of a package of doypack type.
Figure 23:
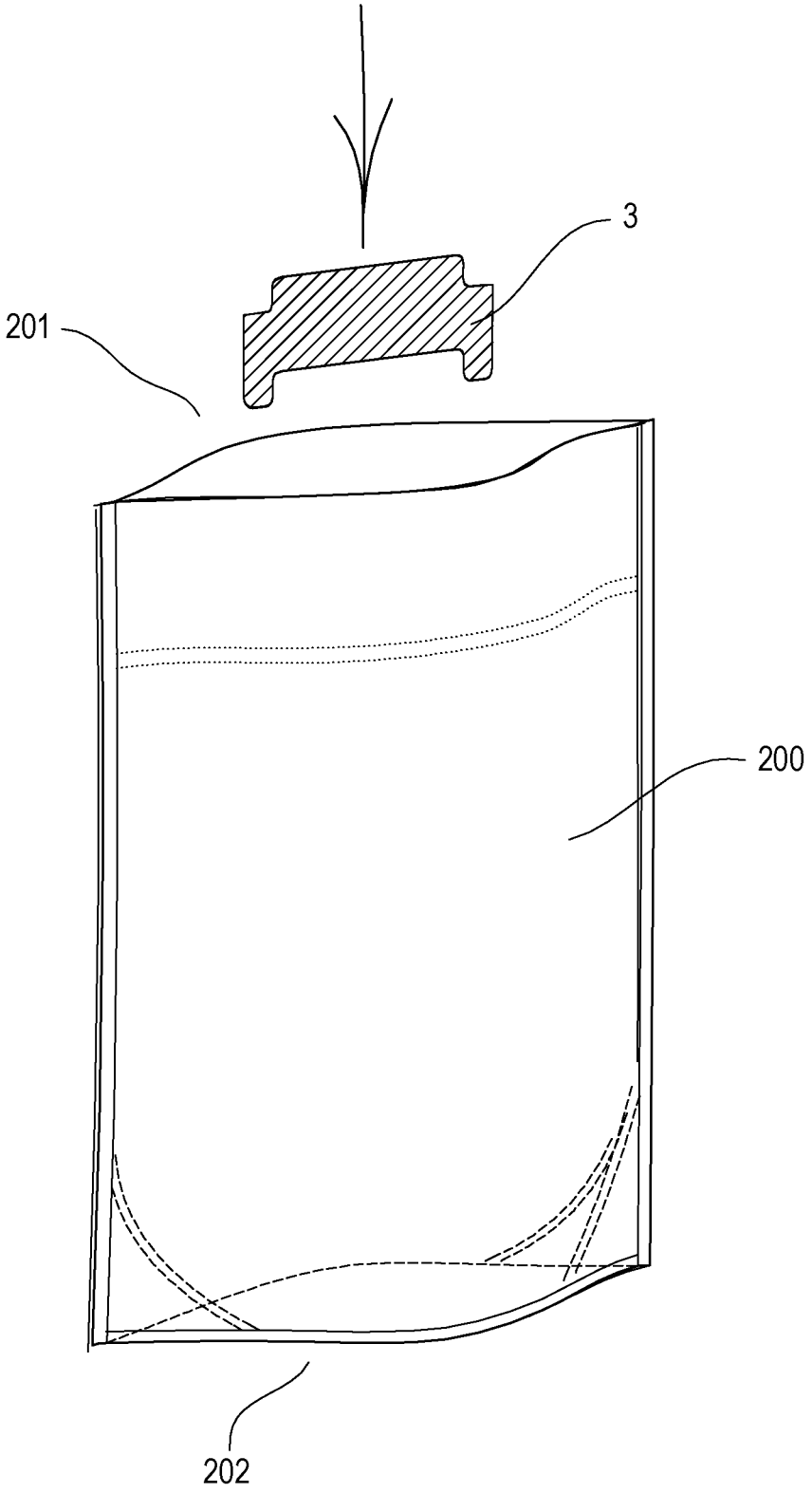
FIG. 23 diagrammatically shows a three-dimensional view of the step of introducing a reinforcing element according to one embodiment of the present invention.
Figure 24:
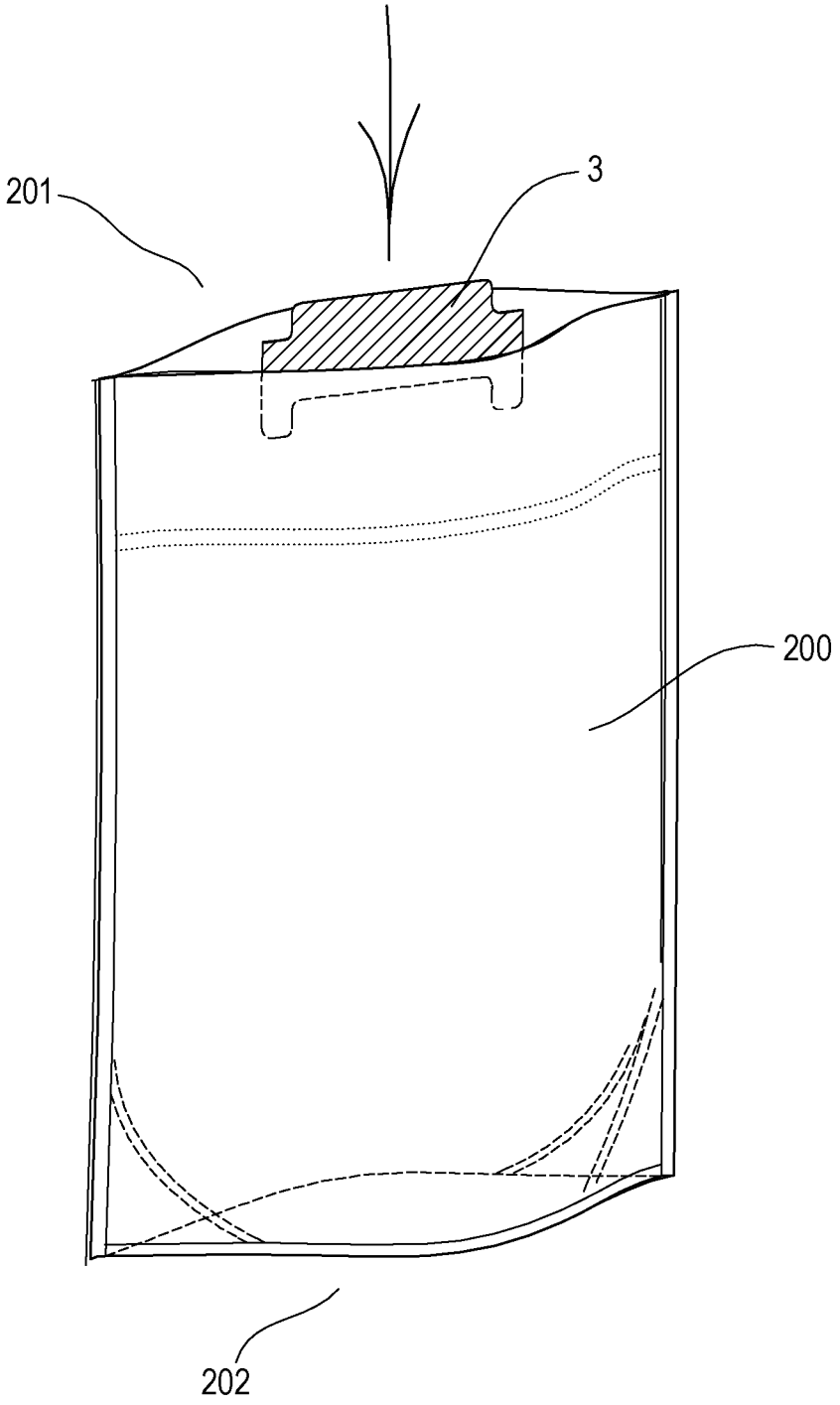
FIG. 24 diagrammatically shows a three-dimensional view of a step successive to the one depicted in FIG. 21 wherein the reinforcing element is introduced at the mouth of the package.
Figure 25:
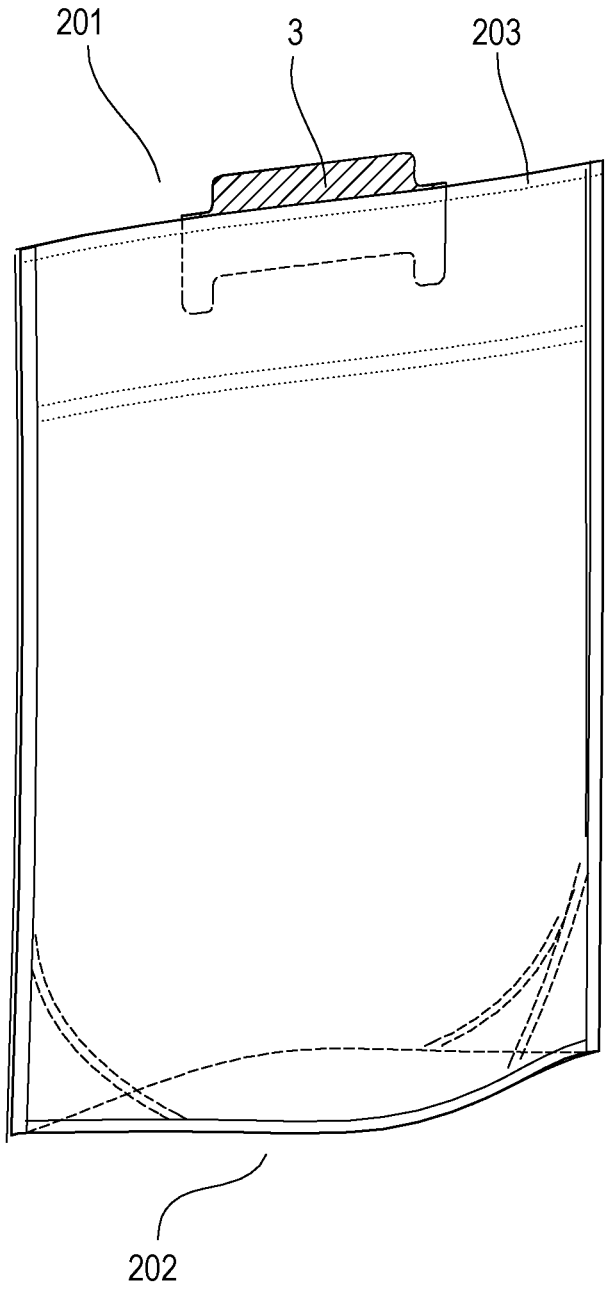
FIG. 25 diagrammatically shows a three-dimensional view of a step successive to the one depicted in FIG. 22 wherein the package was closed by means of first welding.
Figure 26:
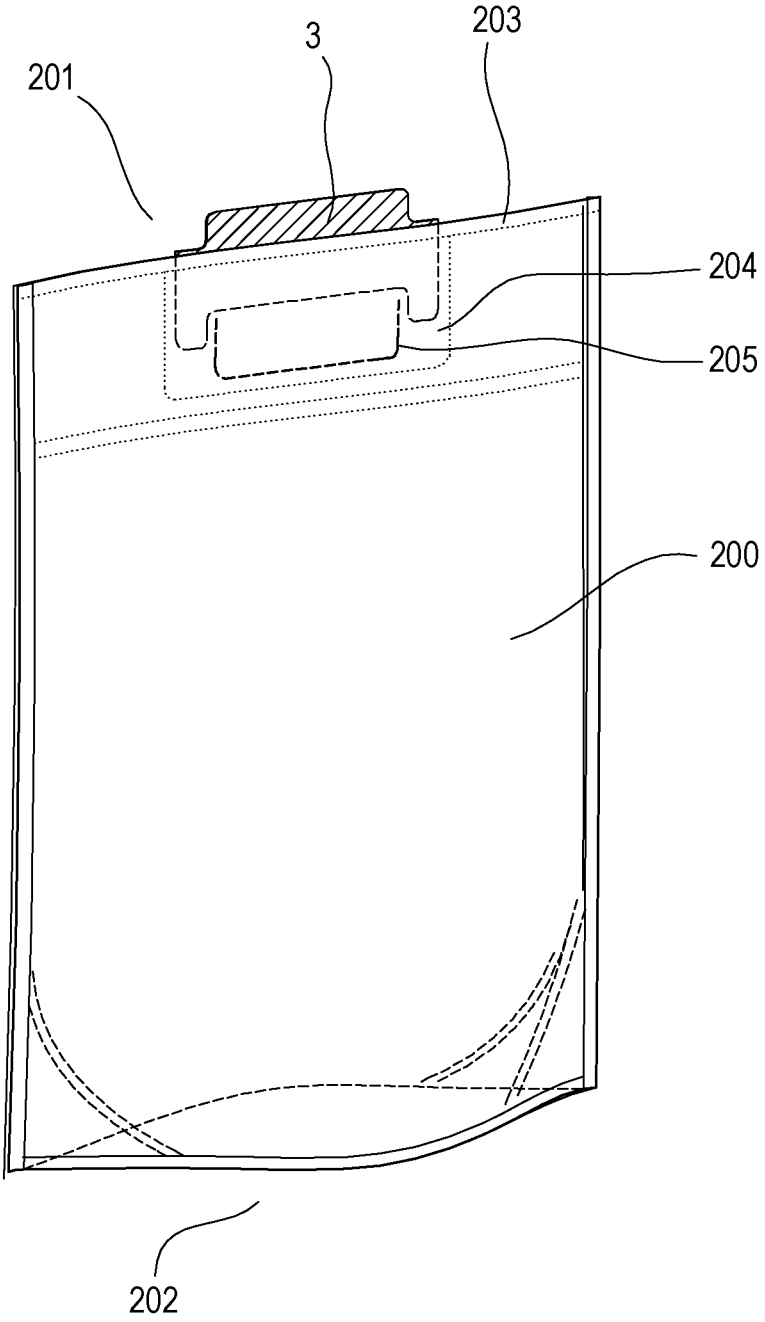
FIG. 26 diagrammatically shows a three-dimensional view of a step successive to the one depicted in FIG. 23 after a second welding and a pre-cut line for the formation of a handled was made according to a particular embodiment of the present invention.

FIGS. 22 to 26 introduce a similar closing method of a package of the doypack 200 type. Similar references were used for elements corresponding to the ones of the package 100 having the side bellows. Accordingly, FIGS. 22 and 26 illustrate a doypack 200 with an upper mouth 201, bottom 202, first seal area 203, second seal area 204 and pre-cut line 205. Different types of reinforcing elements 3 and different types of pre-cut lines may be made also in this case.

As mentioned above, FIGS. 27 to 30 depict two additional examples of reinforcing elements according to two other embodiments of the present invention.

Figure 27:
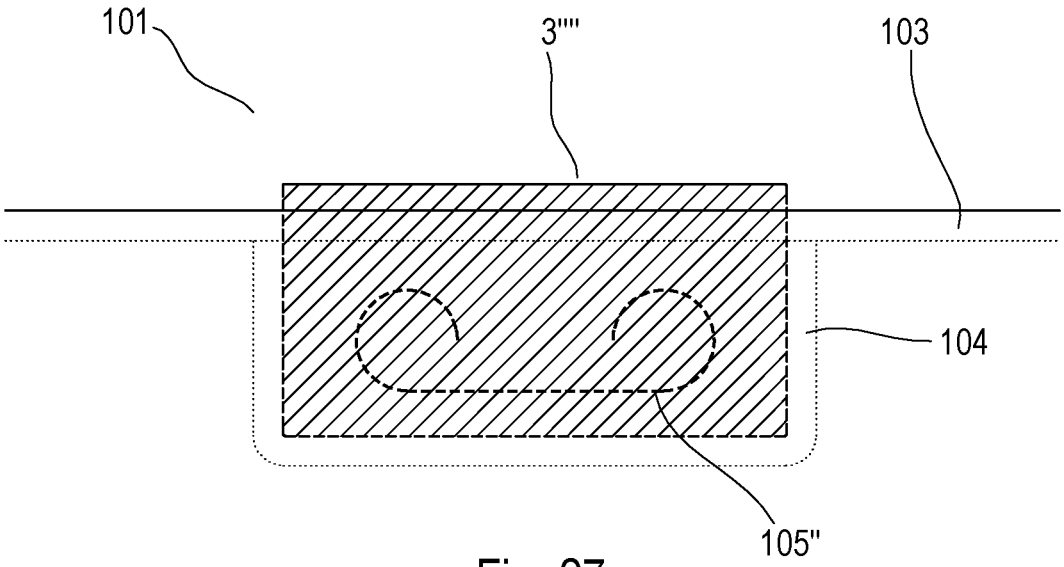
FIG. 27 shows a front view of a detail of the mouth of FIG. 5 with a reinforcing element according to a further embodiment of the present invention.

As shown in FIG. 27, according to the present invention it is also possible for the pre-cut line 105" that allows achieving the cutting means, to be made directly at the position of the reinforcing element 3". In this case, it is possible to have a reinforcing element 3"" of any shape (in the particular example depicted in the drawing, having a rectangular shape) on which the gripping means are directly made. The apparent advantage from such an embodiment is that the tolerances in the relative position between the reinforcing element and the position wherein the pre-cut line 105" is made, are not very limited.

As for the preceding examples, the gripping means are positioned vertically below the reinforcing element also in this case because there is a portion of the reinforcing element 3"" that is vertically above the gripping means and that therefore prevents a possible tear that could be created at the ends of the pre-cut line 105". Nevertheless, it is apparent that even though a reinforcing element 3" having a rectangular shape is shown in the drawing in the particular example, such reinforcing element may have any shape, such as for example an elliptical shape. Nevertheless, in the particular case in which the reinforcing element is provided with a reel, the rectangular shape allows trimmings not to be had and therefore is preferable.

Figure 28:
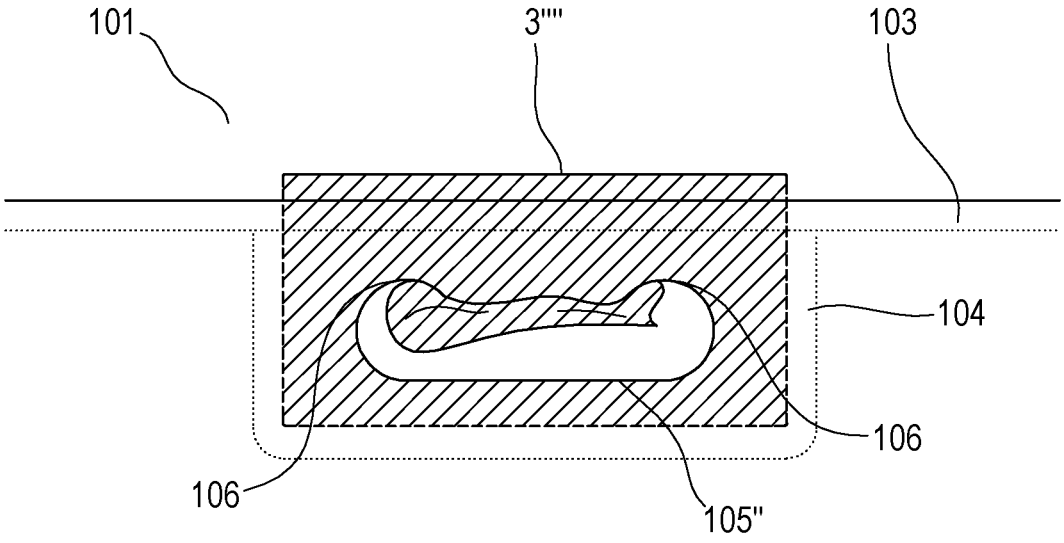
FIG. 28 shows the mouth of FIG. 27 after the handle was used.

FIG. 28 therefore shows the reinforcing element 3"" of FIG. 27 after a user has applied a pressure along the pre-cut line.

Figure 29:
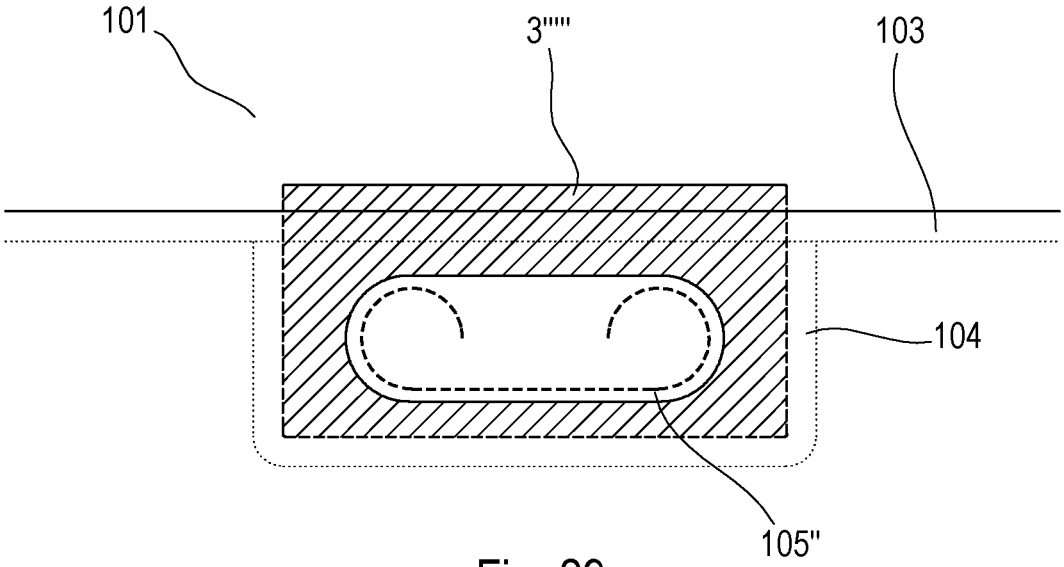
FIG. 29 shows a front view of a detail of the mouth of FIG. 5 with a reinforcing element according to a further embodiment of the present invention.

As instead shown in FIG. 29, the reinforcing element 3" may be represented by a flat body having a cavity inside of which the pre-cut line 105" that allows the formation of the gripping means, may be made.

Also in this case, the shape both of the cavity of the reinforcing element 3"" and of the outer edge of the reinforcing element 3" may vary from the one described in the drawing.

Figure 30:
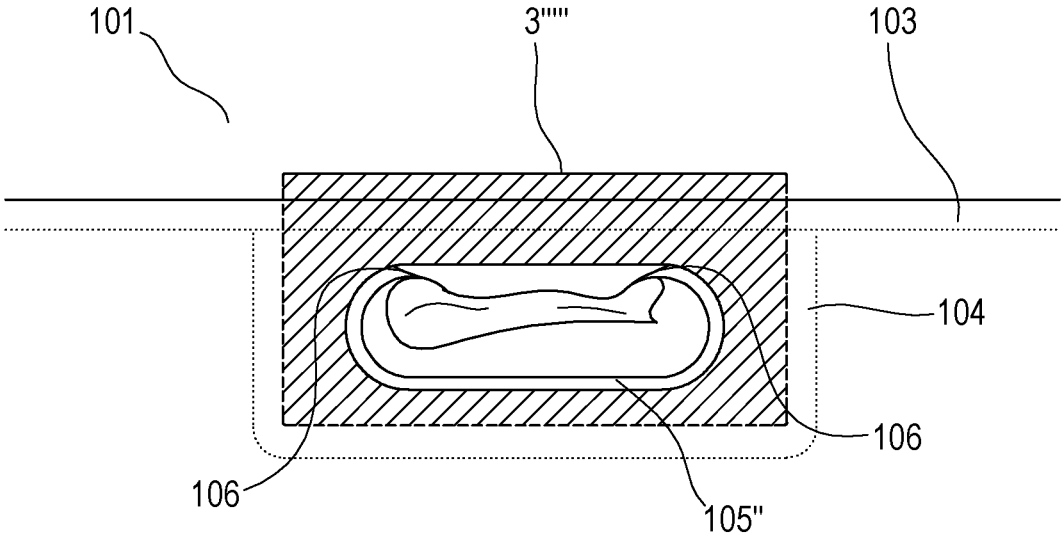
FIG. 30 shows the mouth of FIG. 29 after the handle was used.

Also in this case, as for the preceding example, the gripping means are positioned vertically below the reinforcing element because there is a portion of the reinforcing element 3'" that is vertically above the gripping means and that therefore prevents a possible tear 106 that could be created at the ends of the pre-cut line 105", as clearly shown in FIG. 30.

As described above, to fill the package 100, the package 100 is first filled with the material to be introduced into the package 100 and the package 100 is closed in a subsequent step by means of the above-described process. With regard to the forming process of the package 100, it is divided into three steps. The first coincides with the formation of the package 100, for example by means of formation from a reel, the second step is represented by the filling of the package 100 and the third and last step is represented by the step of closing the package 100 as described above.

Although the present invention was described with reference to the embodiments described above, it is apparent to an expert in the field that it is possible to make several modifications, variants and improvements to the present invention in light of the above teaching and within the scope of the appended claims, without departing from the object and the scope of protection of the invention.

For example, even if two welded areas 103 and 104 adjacent to each other were presented, it is also possible to make two welded areas distant from each other and therefore without adjacent areas. Moreover, it is also possible for the two welded surfaces to be made in a single welding.

Additionally, even if the second welded area 104 was introduced having a maximum width that is smaller with respect to the width of the package, it is also possible for the width of the second welded area 104 to have a width equal to the width of the package. Vice versa, also if the first welded area was introduced with a width equal to the width of the package so as to close the mouth of the package, it is also possible to make a first welded area 103 having a maximum width that is smaller with respect to the package width and is configured only so as to fasten the reinforcing element, thus leaving the second welding with the burden of closing the package.

Moreover, even if the presence of a single pre-cut line 105 and of a single reinforcing element was always described, it is possible for there to be introduced several pre-cut lines and several reinforcing elements to be positioned at each pre-cut line. In the same manner, it is apparent that the reinforcing elements may take on various shapes such as for example, oval, square, or also a combination of several geometrical and non-geometrical shapes.

Moreover, even if the reinforcing element was always positioned partially outside the mouth of the package, it is also possible to position the reinforcing element flush with the mouth of the package or even completely introduced in the mouth of the package, thus being hidden inside the mouth of the package.

Additionally, even if different shapes of the pre-cut line were described, it is also apparent that the pre-cut lines may take on any shape capable of forming gripping means. For example, an oval, rectangular, etc. shape may be used for the pre-cut line. Moreover, to this end, it is apparent that even if certain shapes of the pre-cut line were shown with a particular example of reinforcing element, it is apparent that such invention is not limited to such particular combination.

Finally, those fields known by experts in the field were not described to avoid excessively and uselessly overshadowing the invention described.

Accordingly, the invention is not limited to the embodiments described above, but is only limited by the scope of protection of the appended claims.

What is claimed is:

1. Method for closing a flexible material package, said method comprising the following steps:

a. positioning a reinforcing element, having a flat shape that can be sealed on both faces of the reinforcing element, at an upper mouth of said package between a front wall and a rear wall of said package;

b. sealing a first area close to the upper mouth of said package so as to block said reinforcing element and close the upper mouth of said package by means of the reinforcing element wherein said step a. of positioning is carried out so that the reinforcing element partially protrudes from a first sealed surface outside of the package; and c. cutting along a line adjacent the reinforcing element so as to provide a facilitated opening for forming a handle of the flexible material package, wherein the line is at least partially positioned adjacent to and below the reinforcing element.

2. Method according to claim 1, wherein:

said step of cutting along the line comprises cutting along the line with perforations.

3. Method according to claim 2, further comprising the following step:

d. sealing a second area close to said first sealed area, wherein said line with perforations is positioned within said second sealed area.

4. Method for filling a package comprising the following steps:

a) filling said package;

b) closing said package, wherein said closing is performed with the method according to claim 1.

5. Method for forming a package comprising the following steps:

a) forming said package;

b) filling said package;

c) closing said package, wherein said closing is performed with the method according to claim 1.

6. Method according to claim 1 wherein:

said step of sealing comprises welding.

7. Method for forming a package comprising the following steps, performed in the order in which they are listed:

a) forming said package;

b) filling said package;

c) closing said package, wherein said closing is performed with the method according to claim 1.

8. Method according to claim 1, further comprising the following step:

d. sealing a second area adjacent to the first area, the second area extending between the first area and past an end of the reinforcing element to a second area end, wherein the line is positioned within the second area between the end of the reinforcing element and the second area end.

* * * * *